US010184195B2

(12) United States Patent
Cross et al.

(10) Patent No.: US 10,184,195 B2
(45) Date of Patent: Jan. 22, 2019

(54) KNITTED COMPONENT HAVING AN AUXETIC PORTION AND A TENSILE ELEMENT

(71) Applicant: NIKE, Inc., Beaverton, OR (US)

(72) Inventors: Tory M. Cross, Portland, OR (US); Daniel A. Podhajny, San Jose, CA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/055,688

(22) Filed: Aug. 6, 2018

(65) Prior Publication Data

US 2018/0347083 A1 Dec. 6, 2018

Related U.S. Application Data

(63) Continuation of application No. 15/879,199, filed on Jan. 24, 2018, now Pat. No. 10,066,327, which is a continuation of application No. 14/469,973, filed on Aug. 27, 2014, now Pat. No. 9,903,054.

(51) Int. Cl.

| | |
|---|---|
| ***D04B 1/24*** | (2006.01) |
| ***A43C 1/00*** | (2006.01) |
| ***A43C 1/04*** | (2006.01) |
| ***A43B 13/18*** | (2006.01) |
| ***A43B 13/14*** | (2006.01) |
| ***D04B 1/22*** | (2006.01) |
| ***A43B 23/02*** | (2006.01) |
| ***D04B 1/18*** | (2006.01) |
| ***A43B 1/04*** | (2006.01) |
| ***A43C 5/00*** | (2006.01) |

(52) U.S. Cl.

CPC ..... *D04B 1/24* (2013.01); *A43B 1/04* (2013.01); *A43B 13/14* (2013.01); *A43B 13/181* (2013.01); *A43B 13/187* (2013.01); *A43B 23/0265* (2013.01); *A43C 1/00* (2013.01); *A43C 1/04* (2013.01); *A43C 5/00* (2013.01); *D04B 1/18* (2013.01); *D04B 1/22* (2013.01); *D10B 2403/0241* (2013.01); *D10B 2501/043* (2013.01)

(58) Field of Classification Search

CPC .... D04B 1/24; D04B 1/22; D04B 1/18; A43B 1/04; A43B 13/14; A43B 13/181; A43B 13/187; A43B 23/0275; A43B 23/027; A43B 23/0265

See application file for complete search history.

(56) References Cited

U.S. PATENT DOCUMENTS

| | | | |
|---|---|---|---|
| 8,273,194 | B2 | 9/2012 | Shaw et al. |
| 8,772,187 | B2 | 7/2014 | Ugbolue et al. |
| 8,967,147 | B2 | 3/2015 | Martin |
| 2005/0035031 | A1 | 2/2005 | Alderson et al. |
| 2008/0011021 | A1 | 1/2008 | Starbuck et al. |

(Continued)

*Primary Examiner* — Danny Worrell
(74) *Attorney, Agent, or Firm* — Brinks Gilson & Lione

(57) ABSTRACT

A knitted component may include a knit element that has an auxetic portion configured to move between a first position and a second position as the knitted component stretches. The knitted component may also include a tensile strand inlaid within at least one of a course and a wale of the knit element, where the tensile strand extends through the auxetic portion, and where the tensile strand is selectively securable to the knit element via a securement device. The securement device may be spaced from the auxetic portion.

20 Claims, 15 Drawing Sheets

(56) References Cited

U.S. PATENT DOCUMENTS

| | | | | |
|---|---|---|---|---|
| 2011/0046715 | A1* | 2/2011 | Ugbolue | D04B 21/12 623/1.15 |
| 2011/0155137 | A1* | 6/2011 | Martin | A62B 18/025 128/206.19 |
| 2012/0129416 | A1 | 5/2012 | Anand et al. | |
| 2013/0145651 | A1 | 6/2013 | Podhajny et al. | |
| 2014/0109286 | A1 | 4/2014 | Blakely et al. | |
| 2014/0196315 | A1 | 7/2014 | Beye et al. | |
| 2015/0075033 | A1* | 3/2015 | Cross | A43B 13/22 36/103 |
| 2015/0237957 | A1 | 8/2015 | Cross et al. | |
| 2015/0245685 | A1 | 9/2015 | Cross et al. | |
| 2015/0245686 | A1* | 9/2015 | Cross | A43B 13/02 36/29 |
| 2016/0058098 | A1 | 3/2016 | Cross et al. | |
| 2016/0058121 | A1 | 3/2016 | Langvin et al. | |
| 2016/0219975 | A1* | 8/2016 | Wright | A43B 13/14 |
| 2017/0224052 | A1* | 8/2017 | Lawless | A43B 13/141 |
| 2017/0238652 | A1* | 8/2017 | Langvin | A43B 13/04 |
| 2017/0258178 | A1* | 9/2017 | Cross | A43B 13/125 |
| 2017/0258180 | A1* | 9/2017 | Cross | A43B 13/187 |

* cited by examiner

KNITTED COMPONENT HAVING AN AUXETIC PORTION AND A TENSILE ELEMENT

CROSS-REFERENCE TO RELATED APPLICATIONS

This application is a continuation of U.S. patent application Ser. No. 15/879,199, filed Jan. 24, 2018, which is a continuation of U.S. patent application Ser. No. 14/469,973, filed Aug. 27, 2014, and issued as U.S. Pat. No. 9,903,054. Each of the applications listed in this paragraph is hereby incorporated by reference in its entirety.

BACKGROUND

Articles of apparel, footwear, and other articles can include one or more knitted components. The knitted component can add desirable flexibility and resilient stretchiness to the article. Also, the knitted component can provide suitable softness and texture to the article. The component can also be durable and strong because of the knitted component. Moreover, manufacture of the article can be facilitated due to the efficiencies provided by the knitting process.

For example, articles of footwear can include one or more knitted components. The knitted component can at least partially define the upper of the footwear. The knitted component can be relatively lightweight and, yet, durable enough to withstand the rigors of intense exercise. Furthermore, these knitted articles can provide a unique and attractive appearance to the footwear. Moreover, the footwear can be manufactured efficiently because of the knitted component.

BRIEF SUMMARY

A knitted component is disclosed that is formed of unitary knit construction and that is configured to stretch. The knitted component includes a knit element having an auxetic portion configured to move between a first position and a second position as the knitted component stretches. The knitted component also includes a tensile strand formed of unitary knit construction with the knit element. The auxetic portion has an area when in the first position. The tensile strand engages the knit element proximate the auxetic portion. The tensile strand is configured to be manipulated for selectively changing the area of the auxetic portion to vary a stretch characteristic of the knitted component.

Furthermore, an article of footwear is disclosed that includes a sole structure and an upper that is attached to the sole structure. The upper includes a stretchable knitted component formed of unitary knit construction. The knitted component includes a knit element having an auxetic portion. The auxetic portion is configured to move between a first position and a second position as the knitted component stretches. The knitted component further includes a tensile strand formed of unitary knit construction with the knit element. The auxetic portion has an area when in the first position. The tensile strand engages the auxetic portion. The tensile strand is configured to be manipulated for selectively changing the area of the auxetic portion to vary a stretch characteristic of the knitted component.

Moreover, a knitted component is disclosed that is formed of unitary knit construction. The knitted component is configured to stretch. The knitted component includes a knit element with an auxetic portion that is configured to move between a first position and a second position as the knitted component stretches. The auxetic portion has a border. The knitted component further includes a tensile strand that is inlaid within the knit element and is formed of unitary knit construction with the knit element. The auxetic portion has an area when in the first position. The tensile strand extends across the auxetic portion and engages a first location and a second location of the border. The tensile strand is configured to be manipulated for selectively moving the first location relative to the second location to change the area of the auxetic portion to vary a stretch characteristic of the knitted component.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Example embodiments will now be described more fully with reference to the accompanying drawings.

The following discussion and accompanying figures disclose a variety of concepts relating to knitted components. These knitted components can be used and/or incorporated in various objects, such as an article of footwear, an article of apparel, or other articles.

Moreover, the following discussion and accompanying figures disclose knitted components that exhibit auxetic characteristics during stretching. It will be appreciated that the term "auxetic" as used herein will generally refer to objects that have a negative Poisson's ratio. Thus, when stretching force is applied to an auxetic knitted component, the knitted component can elongate in the same direction that the stretching force is applied, and the knitted component can also expand in another direction, for example, in a direction that is perpendicular to the applied force. Furthermore, the term "auxetic" as used herein will refer to objects that exhibit a negative Poisson's ratio within certain kinds of stretching and that exhibit a positive Poisson's ratio within other kinds of stretching.

Furthermore, the knitted components can have resiliency for recovering back toward an unstretched or neutral position once the stretching force is reduced. For example, in some embodiments, the knitted component can include one or more portions that exhibit auxetic characteristics when stretched and that recover back toward the neutral position when released.

Additionally, the following discussion and accompanying figures disclose a variety of concepts that allow auxetic portions and/or stretching characteristics of the knitted component to be selectively varied. For example, in some embodiments, the knitted component can include one or more features that allow a user to select and change the size, shape, and/or surface area of the auxetic portion. As a result, the user can alter the stretch characteristics of the auxetic portion and/or the stretch characteristics of the knitted component.

Configurations of Exemplary Knitted Components

Figure 1:
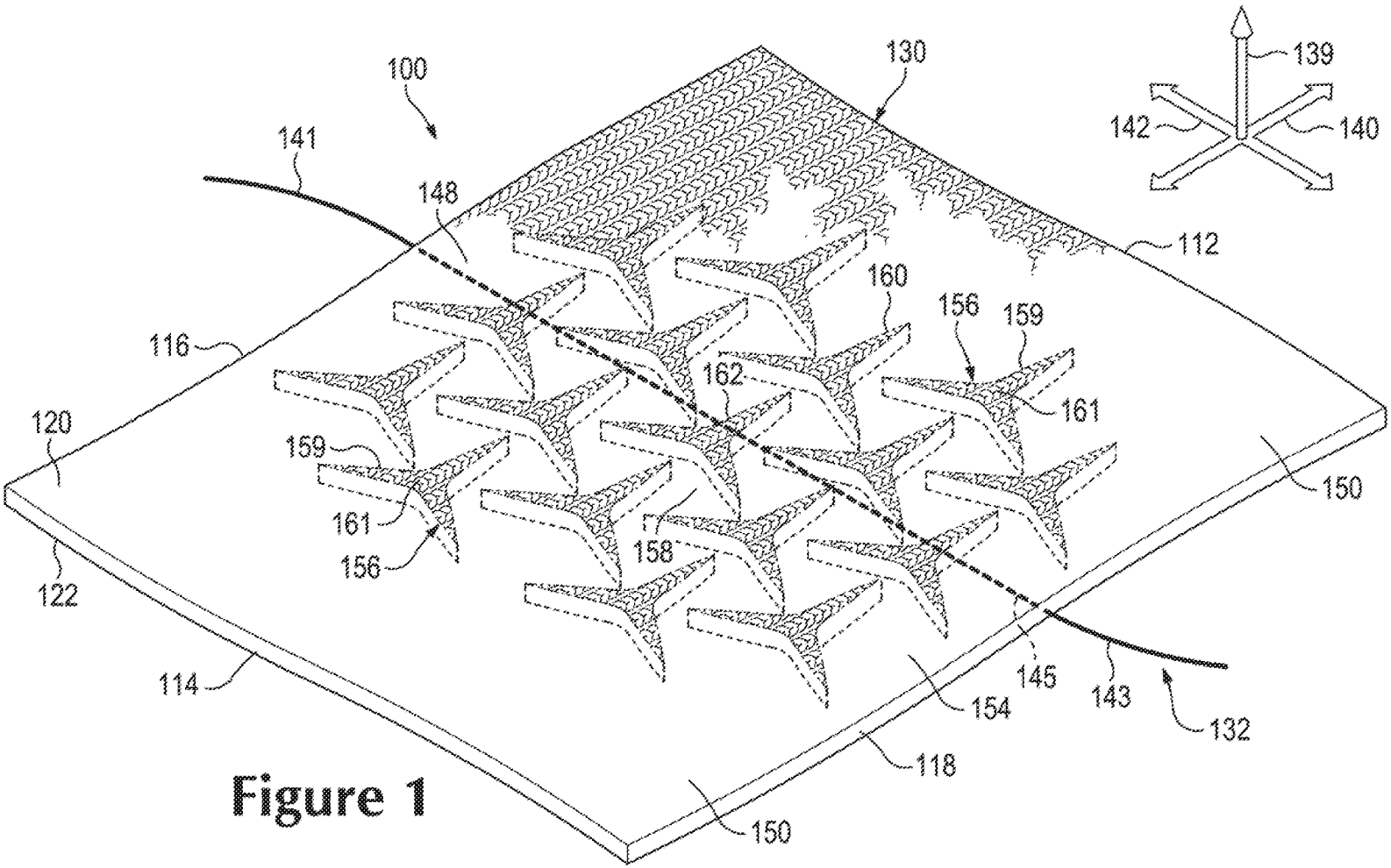
FIG. 1 is an isometric view of a knitted component with auxetic portions according to exemplary embodiments of the present disclosure.

Referring initially to FIG. 1, a knitted component 100 is illustrated according to exemplary embodiments of the present disclosure. Knitted component 100 can have a variety of shapes, sizes, and characteristics. Also, knitted component 100 can be configured and/or incorporated into a specific object. For example, knitted component 100 can be incorporated into an article of footwear in some embodiments. In additional embodiments, knitted component 100 can be incorporated into an article of apparel.

Figure 5:
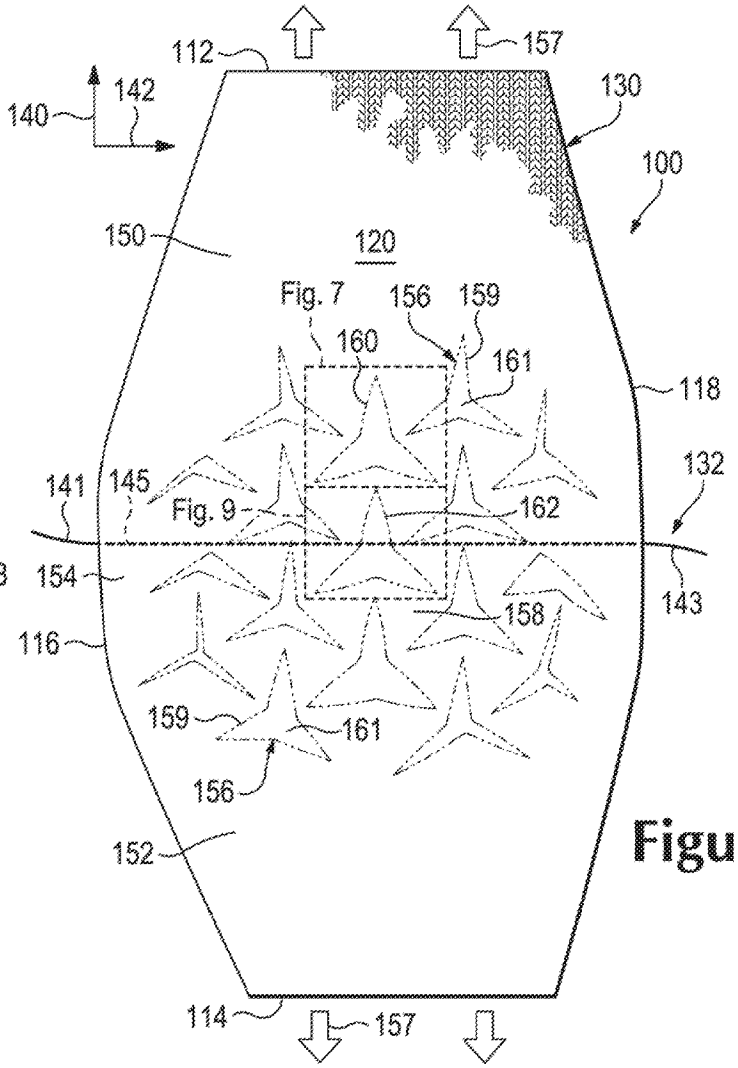
FIG. 5 is a top view of the knitted component of FIG. 1 shown in a second, stretched position.
Figure 4:
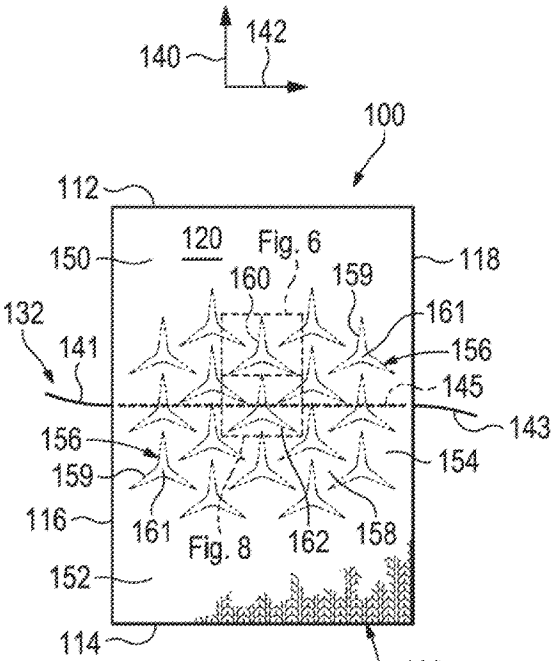
FIG. 4 is a top view of the knitted component of FIG. 1 shown in a first, neutral position.

As shown in the exemplary embodiment of FIG. 1, knitted component 100 can be relatively thin and sheet-like. Knitted component 100 can also be flexible and stretchable in some embodiments. Additionally, in some embodiments, knitted component 100 can be resilient. As such, the knitted component 100 can stretch when a stretching load is applied, and when the stretching load is reduced, the knitted component 100 can recover back toward its original size. By way of example, FIG. 4 illustrates knitted component 100 in a neutral position, and FIG. 5 illustrates knitted component 100 in a stretched position.

As shown in FIG. 1, knitted component 100 can define a polygonal shape. In some embodiments, for example, knitted component 100 can define a quadrilateral and can include four sides. More specifically, as shown in FIGS. 1 and 4, knitted component 100 can include a first edge 112, a second edge 114, a third edge 116, and a fourth edge 118. Edges 112, 114, 116, 118 can be disposed at any suitable angle relative to each other. Thus, knitted component 100 can define a rectangle, a parallelogram, or other quadrilateral. However, it will be appreciated that knitted component 100 can have any suitable shape, including a rounded shape, such as a circle, an oval, or other rounded shape.

Additionally, knitted component 100 can include a front face 120 and a back face 122. Knitted component 100 can have any suitable thickness measured between front face 120 and back face 122. The thickness can be substantially constant across knitted component 100 in some embodiments. In other embodiments, the thickness can vary. Also, in some embodiments, front face 120 and/or back face 122 can define one or more raised areas, one or more recessed areas, ribs, waves, or other surface variations.

Moreover, knitted component 100 can extend in various directions. For example, knitted component 100 can span primarily in a first direction 140 and a second direction 142. Also, a thickness of knitted component 100 can be measured between front face 120 and back face 122 substantially in a third direction 139. Moreover, third edge 116 and fourth edge 118 extend substantially in the first direction 140, and first edge 112 and second edge 114 extend substantially in the second direction 142.

Knitted component 100 can be formed from a plurality of interconnected yarns, cables, fibers, filaments, or other strands. Also, knitted component 100 can be formed of unitary knit construction.

As defined herein and as used in the claims, the term "unitary knit construction" means that the knitted component 100 is formed as a one-piece element through a knitting process. That is, the knitting process substantially forms the various features and structures of knitted component 100 without the need for significant additional manufacturing steps or processes. A unitary knit construction may be used to form a knitted component having structures or elements that include one or more courses of yarn or other knit material that are joined such that the structures or elements include at least one course in common (i.e., sharing a common strand or common yarn) and/or include courses that are substantially continuous between each portion of the knitted component 100. With this arrangement, a one-piece element of unitary knit construction is provided.

Although portions of knitted component 100 may be joined to each other following the knitting process, knitted component 100 remains formed of unitary knit construction because it is formed as a one-piece knit element. Moreover, knitted component 100 remains formed of unitary knit construction when other elements (e.g., an inlaid strand, a closure element, logos, trademarks, placards with care instructions and material information, and other structural elements) are added following the knitting process.

Knitted component 100 can generally include a knit element 130 and one or more tensile strands 132. Knit element 130 and tensile strand 132 can be formed of unitary knit construction with each other.

Knit element 130 can define a majority of knitted component 100. Thus, knit element 130 can substantially define front face 120, back face 122, first edge 112, second edge 114, third edge 116, and fourth edge 118 in some embodiments. Knit element 130 can be stretchable in some embodiments. To provide this stretchability, knit element 130 may be formed with a yarn or strand that is configured to stretch, such as an elastic yarn, in some embodiments. Also, in some embodiments, knit element 130 may be stretchable due to the knit structure used to form the knit element 130.

Also, at least a portion of tensile strand 132 can extend across and/or through knit element 130 in some embodiments. For example, tensile strand 132 can include a first end 141, a second end 143, and a middle portion 145 that extends longitudinally between first end 141 and second end 143. As shown in FIGS. 1 and 4, middle portion 145 can extend across and through knit element 130. First end 141 and second end 143 can extend out from and can be exposed from knit element 130. Specifically, in some embodiments, first end 141 can extend from third edge 116, second end 143 can extend from fourth edge 118, and middle portion 145 can extend across knit element 130 substantially in the second direction 142. However, it will be appreciated that tensile strand 132 can be disposed relative to knit element 130 in any suitable location. For example, in other embodiments, first end 141 and/or second end 143 of tensile strand 132 can be unexposed and embedded in knit element 130. Also, in some embodiments, one or more areas of middle portion 145 can be exposed from knit element 130.

Tensile strand 132 can provide support to knitted component 100. More specifically, in some embodiments, tension of strand 132 can allow knitted component 100 to resist deformation, resist stretching, or otherwise provide support for an object that is disposed proximate knitted component 100. Also, tensile strand 132 can be used to vary, adjust, tailor, select, or otherwise change one or more characteristics of knit element 130 and knitted component 100. For example, strand 132 can be manipulated by the wearer, by the manufacturer, by an automated actuator, or by another input to change the characteristic. By manipulating strand 132, various characteristics can be changed. For example, in some embodiments, stretchiness, stretch resistance, range of stretching of knitted component 100, or other characteristics relating to stretching can be varied. Also, in some embodiments, one or more dimensions of knitted component 100 can be changed by adjusting tensile strand 132.

Figure 2:
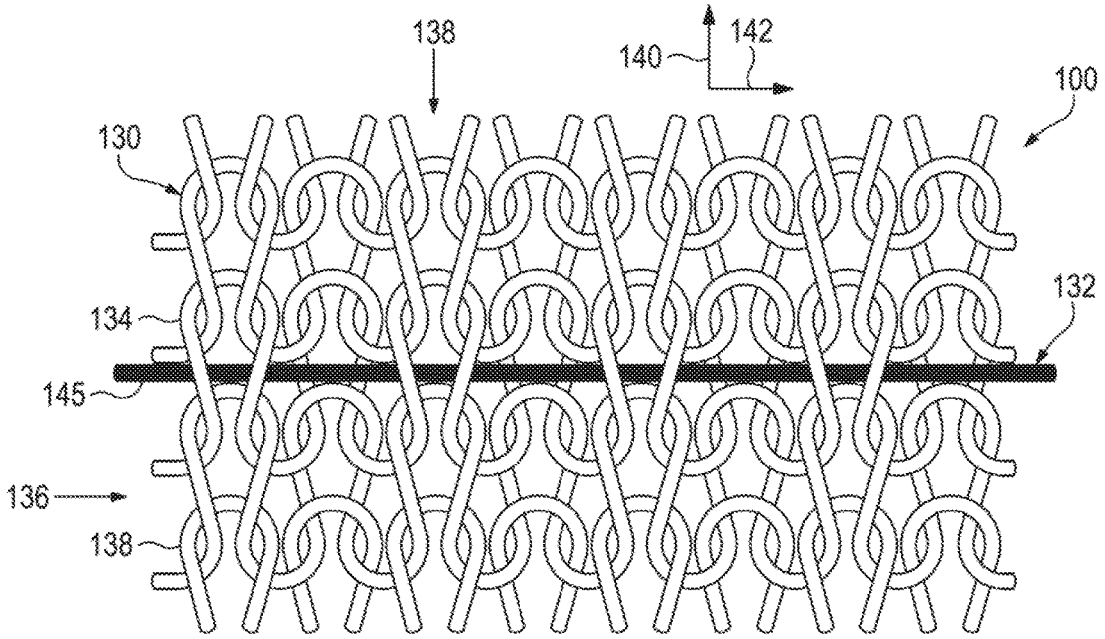
FIG. 2 is a detail view of the knitted component of FIG. 1 according to exemplary embodiments of the present disclosure.
Figure 3:
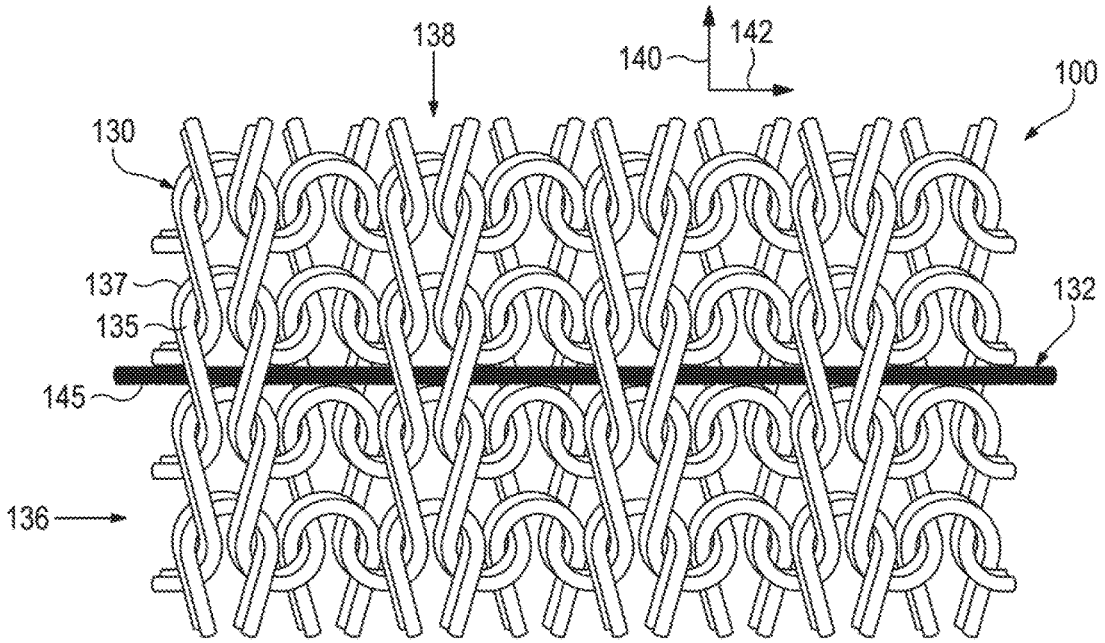
FIG. 3 is a detail view of the knitted component of FIG. 1 according to additional embodiments of the present disclosure.

Referring now to FIGS. 2 and 3, knit element 130 and tensile strand 132 will be discussed in greater detail according to various embodiments. As shown in FIG. 2, knit element 130 of knitted component 100 may be formed from at least one yarn 134, cable, filament, fiber, or other strand that is manipulated (e.g., with a knitting machine) to form a plurality of intermeshed loops. The loops can be intermeshed in a plurality of courses 136 extending in the second direction 142 and a plurality of wales 138 extending in the first direction 140. Moreover, as shown in FIG. 2, knit element 130 and tensile strand 132 can be formed of unitary knit construction.

Tensile strand 132 can be attached to and engaged with knit element 130 in any suitable fashion. For example, in some embodiments, at least a portion of strand 132 can be inlaid within one or more courses 136 and/or wales 138 of knit element 130 such that strand 132 can be incorporated during the knitting processes on the knitting machine. More specifically, as shown in the embodiment of FIG. 2, tensile strand 132 can alternate between being located: (a) behind loops formed from yarn 134; and (b) in front of loops formed from yarn 134. In effect, tensile strand 132 weaves through the unitary knit construction of knit element 130. As a result, in some embodiments, tensile strand 132 can be disposed within knit element 130 between front face 120 and back face 122 of knitted component 100.

In the embodiment of FIG. 2, strand 132 is shown inlaid within a single course 136 and, thus, strand 132 extends primarily in the second direction 142. However, it will be appreciated that strand 132 can be inlaid within a single wale 138 of knit element 130 such that strand 132 extends primarily in the first direction 140. In other embodiments, different segments of strand 132 can extend along different courses 136 of knit element 130. Additionally, in some embodiments, different segments of strand 132 can extend along different wales 138 of knit element 130. Furthermore, in some embodiments, strand 132 can extend across knit element 130 in both the first direction 140 and the second direction 142.

Yarn(s) 134 that form knit element 130 can be of any suitable type. For example, yarn 134 of knit element 130 can be made from cotton, elastane, rayon, wool, nylon, polyester, or other material. Also, in some embodiments, yarn 134 can be elastic and resilient. As such, yarn 134 can be stretched in length from a first length, and yarn 134 can be biased to recover to its first length. Thus, such an elastic yarn 134 can allow knit element 130 to stretch elastically and resiliently under the influence of a force. When that force is reduced, knit element 130 can recover back its neutral position.

Furthermore, in some embodiments, yarn 134 can be at least partially formed from a thermoset polymer material that can melt when heated and that can return to a solid state when cooled. As such, yarn 134 can be a fusible yarn and can be used to join two objects or elements together. In additional embodiments, knit element 130 can include a combination of fusible and non-fusible yarns. In some embodiments, for example, knitted component 100 can be constructed according to the teachings of U.S. Patent Publication No. 2012/0233882, which published on Sep. 20, 2012, and the disclosure of which is hereby incorporated by reference in its entirety. Knitted component 100 can also be constructed according to the teachings of U.S. Patent Publication No. 2014/0150292, which published on Jun. 5, 2014, and which is hereby incorporated by reference in its entirety.

Additionally, in some embodiments, a single yarn 134 can form each of the courses 136 and wales 138 of knit element 130. In other embodiments, knit element 130 can include a plurality of yarns. For example, different yarns can form different courses 136 and/or different wales 138. In additional embodiments, a plurality of yarns can cooperate to define a common loop, a common course, and/or a common wale. For example, as shown in FIG. 3, knitted component 100 can include a plurality of yarns that are grouped together, that overlie each other, and that extend generally in the same longitudinal direction through respective courses 136. In some embodiments, for example, a first yarn 135 can be formed from at least one of a thermoset polymer material and natural fibers (e.g., cotton, wool, silk). Also, a second yarn 137 may be formed from a thermoplastic polymer material, such as a fusible yarn of the type disclosed in U.S.

Pat. No. 6,910,288, issued Jun. 28, 2005 to Dua, entitled "Footwear Incorporating a Textile with Fusible Filaments and Fibers," and which is hereby incorporated by reference in its entirety.

Tensile strand 132 can also be of any suitable type of strand, yarn, cable, cord, filament (e.g., a monofilament), thread, rope, webbing, or chain, for example. In comparison with the yarn(s) 134 of knit element 130, the thickness of tensile strand 132 may be greater. In some configurations, tensile strand 132 may have a significantly greater thickness than the yarns of knit element 130. Although the cross-sectional shape of tensile strand 132 may be round, triangular, square, rectangular, elliptical, or irregular shapes may also be utilized. Moreover, the materials forming tensile strand 132 may include any of the materials for the yarn 134 of knit element 130, such as cotton, elastane, polyester, rayon, wool, and nylon. As noted above, tensile strand 132 may exhibit greater stretch-resistance than knit element 130. As such, suitable materials for tensile strand 132 may include a variety of engineering filaments that are utilized for high tensile strength applications, including glass, aramids (e.g., para-aramid and meta-aramid), ultra-high molecular weight polyethylene, and liquid crystal polymer. As another example, a braided polyester thread may also be utilized as tensile strand 132.

Tensile strand 132 and other portions of knitted component 100 can additionally incorporate the teachings of one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010; U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012; U.S. patent application Ser. No. 13/781,336 to Podhajny, entitled "Method of Knitting A Knitted Component with a Vertically Inlaid Tensile Element", filed on Feb. 28, 2013 and published as U.S. Patent Application Publication Number 2014/0237861 A1 on Aug. 28, 2014, each of which is hereby incorporated by reference in its entirety.

Referring now to FIGS. 1 and 4, knit element 130 will be discussed in greater detail according to exemplary embodiments. Knit element 130 can include multiple knit structures, zones, areas, or portions that are formed of unitary knit construction but that have different characteristics. These different characteristics can relate to appearance, stitch density, texture, stretch resistance, elasticity, resilience, or other characteristics.

For example, knit element 130 can include a first region 150 proximate first edge 112, a second region 152 proximate second edge 114, and a third region 154 disposed between first and second regions 150, 152. In some embodiments, first region 150 and second region 152 can be substantially uniform and continuous. In contrast, third region 154 can include a plurality of knit zones that differ in one or more ways. For example, third region 154 can include one or more auxetic portions 156 and an adjacent zone 158 that is disposed adjacent the auxetic portion(s) 156.

In some embodiments represented in FIGS. 1 and 4, third region 154 can include a plurality of auxetic portions 156 that are spaced apart from each other in the first direction 140 and the second direction 142. Adjacent zone 158 of knit element 130 can be defined between auxetic portions 156. In some embodiments, adjacent zone 158 can continuously encompass, border, or surround one or more of auxetic portions 156. Adjacent zone 158 can also be substantially continuous (i.e., formed as a one-piece element with) one or more auxetic portions 156. Also, adjacent zone 158 can be substantially continuous with first region 150 and second region 152 in some embodiments. Thus, auxetic portions 156, adjacent zone 158, first region 150, and second region 152 can be formed of unitary knit construction. Additionally, as represented in FIG. 1, auxetic portions 156 can be exposed on front face 120 and back face 122 of knit element 130. Moreover, in some embodiments, auxetic portions 156 can be incorporated in adjacent zone 158 of knit element 130 through known intarsia knitting processes.

In some embodiments, auxetic portions 156 can be defined by a border 159 and an interior area 161. Border 159 can demarcate the respective auxetic portion 156 from adjacent zone 158 of knit element 130 in some embodiments. In some embodiments, border 159 can continuously encompass and frame interior area 161. Furthermore, the size or area of interior area 161 of auxetic portion 156 can be defined within border 159. Also, in some embodiments, border 159 can be spaced apart from edges 112, 114, 116, 118 of knitted component 100. In other embodiments, border 159 can intersect first edge 112, second edge 114, third edge 116, and/or fourth edge 118.

Auxetic portion 156 can have any suitable size or area. For example, in some embodiments, auxetic portion 156 can have an area between approximately 0.25 square inches (in2) to approximately 5 square inches (in2) when in the unstretched, neutral position.

Auxetic portions 156 can have one or more different physical properties than first region 150, second region 152, and/or adjacent zone 158. For example, auxetic portions 156 can be more elastic, more stretchable, and less stiff than first region 150, second region 152, and/or adjacent zone 158. Stated differently, auxetic portions 156 can have a smaller degree or smaller amount of stretch resistance than first region 150, second region 152, and/or adjacent zone 158.

These differences in elasticity can be achieved in various ways. For example, in some embodiments, the knit construction of auxetic portion 156 can be different from first region 150, second region 152, and/or adjacent zone 158 to cause auxetic portions 156 to be more elastic than first region 150, second region 152, and adjacent zone 158.

Additionally, in some embodiments, auxetic portions 156 can be constructed from yarns that are more elastic than the yarns of first region 150, second region 152, and/or adjacent zone 158 to cause this difference in elasticity. More specifically, in some embodiments, auxetic portions 156 can be formed using one or more elastic, stretchable yarns. In contrast, first region 150, second region 152, and adjacent zone 158 can be formed using less elastic or substantially inelastic yarns.

Also, in some embodiments, first region 150, second region 152, and adjacent zone 158 can be formed from yarns made from a thermoplastic. In some embodiments, these thermoplastic yarns can be heated and partially melted and fused to adjacent yarns to impart additional stiffness to the respective areas of knit element 130. In some embodiments, these thermoplastic yarns can be absent from auxetic portions 156.

In additional embodiments, a coating or skin can be applied to first region 150, second region 152, and adjacent zone 158 to impart additional stiffness to these areas of knit element 130. This coating or skin can be absent from auxetic portions 156.

Knitted component 100 can stretch from a first position (i.e., neutral position) represented in FIG. 4 to a second position (i.e., stretched position) represented in FIG. 5. It will be appreciated that FIGS. 4 and 5 represent an exemplary embodiment of the stretching of knitted component 100; however, it will be appreciated that knitted component 100 can exhibit different stretching behavior without departing from the scope of the present disclosure.

As shown in the embodiment of FIG. 5, a stretching force can be applied as indicated by arrows 157. As a result, knitted component 100 can stretch such that first edge 112 and second edge 114 move away from each other and such that knitted component 100 elongates in the first direction 140. Because the auxetic portions 156 exhibit auxetic characteristics, this stretching can also cause third edge 116 and fourth edge 118 to move away from each other and cause knitted component 100 to become wider in the second direction 142. For example, as shown in FIG. 5, third region 154 can bulge in the second direction 142 whereas first region 150 and second region 152 can remain substantially the same width in the second direction 142. This stretching behavior will be discussed in greater detail below.

Moreover, as discussed in detail below, tensile strand 132 can engage knit element 130 proximate at least one of the plurality of auxetic portions 156. Tensile strand 132 can engage any number of the auxetic portions 156. Additionally, tensile strand 132 can be manipulated to selectively change one or more dimensions of auxetic portion 156. As a result, stretching behavior of auxetic portion 156 and/or knit element 130 can be selectively changed.

Embodiments of Auxetic Portions

Auxetic portions 156 will now be discussed in detail according to exemplary embodiments. Initially, the shape and geometry of auxetic portions 156 will be discussed with reference to FIGS. 4, 6, and 8. It will be appreciated that auxetic portions 156 shown in FIGS. 6 and 8 can be representative of other auxetic portions 156 of knitted component 100.

Border 159 of auxetic portions 156 may have any kind of geometry. In some embodiments, one or more borders 159 may have a polygonal geometry. The shape of auxetic portion 156 may be characterized as a regular polygon in some embodiments, such that angles defined between adjacent sides are equal to corresponding angles within the polygon. Also, border 159 may be characterized as comprising a particular number of vertices and edges (or sides). These edges can be substantially straight in some embodiments. Additionally, these edges can be curved in some embodiments.

Other geometries are also possible, including a variety of polygonal and/or curved geometries. Exemplary polygonal shapes that may be used with one or more of auxetic portions 156 include, but are not limited to, regular polygonal shapes (e.g., triangular, rectangular, pentagonal, hexagonal, etc.) as well as irregular polygonal shapes or non-polygonal shapes. Other geometries could be described as being quadrilateral, pentagonal, hexagonal, heptagonal, octagonal or other polygonal shapes with reentrant sides. Moreover, some embodiments can include borders 159 having a geometry that includes both straight edges connected via vertices as well as curved or non-linear edges without any points or vertices.

Figure 6:
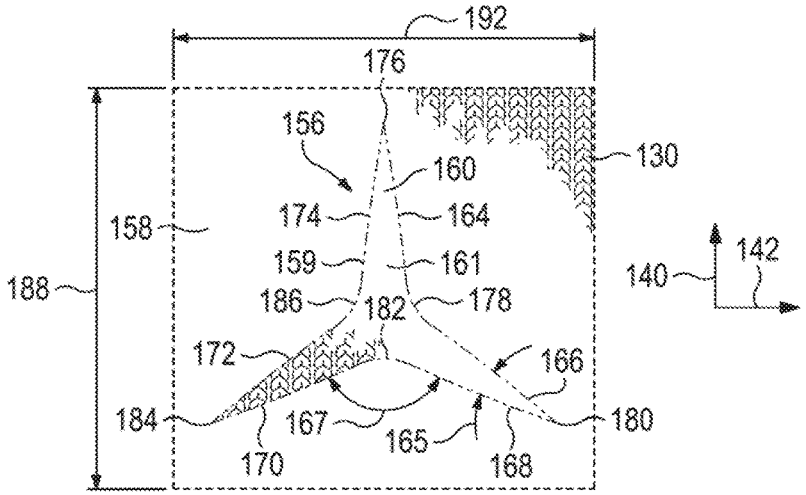
FIG. 6 is a detail view of FIG. 4, wherein a portion of the knitted component is shown in the neutral position.
Figure 8:
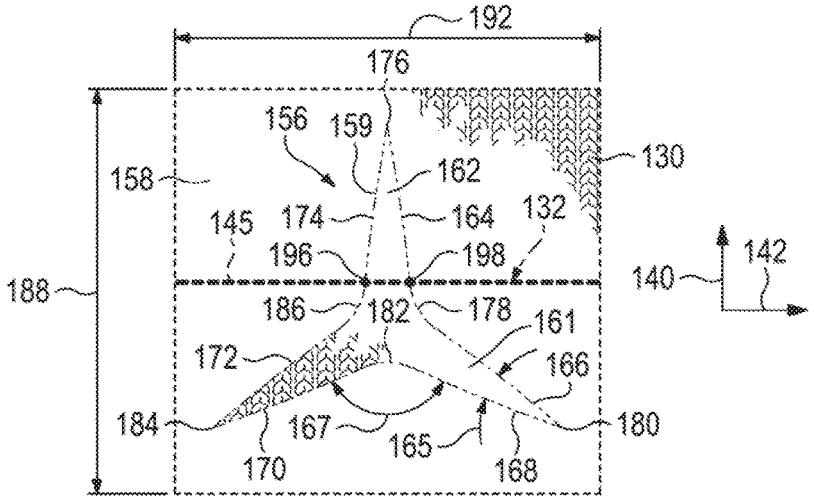
FIG. 8 is a detail view of FIG. 4, wherein the portion of the knitted component is shown in the neutral position.

With regard to the embodiments of FIGS. 6 and 8, auxetic portion 156 may be characterized as having six sides and six vertices. For example, auxetic portion 156 can include a first side 164, a second side 166, a third side 168, a fourth side 170, a fifth side 172, and a sixth side 174. Additionally, auxetic portion 156 can include a first vertex 176, a second vertex 178, a third vertex 180, a fourth vertex 182, a fifth vertex 184, and a sixth vertex 186. First side 164 and sixth side 174 can intersect at first vertex 176. First side 164 and second side 166 can intersect at second vertex 178. Second side 166 and third side 168 can intersect at third vertex 180. Third side 168 and fourth side 170 can intersect at fourth vertex 182. Fourth side 170 and fifth side 172 can intersect at fifth vertex 184. Fifth side 172 and sixth side 174 can intersect at sixth vertex 186.

Additionally, in some embodiments, the geometry of auxetic portion 156 can be shaped substantially as a so-called re-entrant triangle. Accordingly, auxetic portion 156 can be characterized as a triangle with sides that, instead of being straight, have an inwardly-pointing vertex at the midpoint of the side. Thus, second vertex 178, fourth vertex 182, and sixth vertex 186 can be disposed closer to a center of interior area 161 than first vertex 176, third vertex 180, and fifth vertex 184. Stated differently, second vertex 178, fourth vertex 182, and sixth vertex 186 can each be characterized as an "inwardly-pointing vertex." In contrast, first vertex 176, third vertex 180, and fifth vertex 184 can each be characterized as an "outwardly-pointing vertex." Inwardly-pointing vertices 178, 182, 186 can define an exterior angle 167 (i.e., a re-entrant angle). In some embodiments, exterior angle 167 can range from approximately 120 degrees to 180 degrees. Additionally, the vertices of auxetic portion 156 may define a plurality of interior angles 165. For example, interior angles 165 can be defined at first vertex 176, third vertex 180, and fifth vertex 184. In some embodiments, first vertex 176, third vertex 180, and fifth vertex 184 can have an interior angle 165 that is less than 180 degrees when auxetic portion 156 is in the neutral, unstretched position.

In some embodiments, auxetic portions 156 may be arranged in a regular pattern on knit element 130. Auxetic portions 156 can be substantially evenly spaced from each other across knit element 130. In some embodiments, auxetic portions 156 may be arranged such that each vertex of one auxetic portion 156 is disposed near the vertex of another auxetic portion 156 (e.g., an adjacent or nearby auxetic portion 156). More specifically, in some embodiments, first vertex 176 of one auxetic portion 156 can be disposed near, or adjacent to, fourth vertex 182 of another auxetic portion 156. Similarly, second vertex 178 of one auxetic portion 156 can be disposed near, or adjacent to, a fifth vertex 184 of another auxetic portion 156. Moreover, third vertex 180 of one auxetic portion 156 can be disposed near, or adjacent to, a sixth vertex 186 of another auxetic portion 156.

Figure 7:
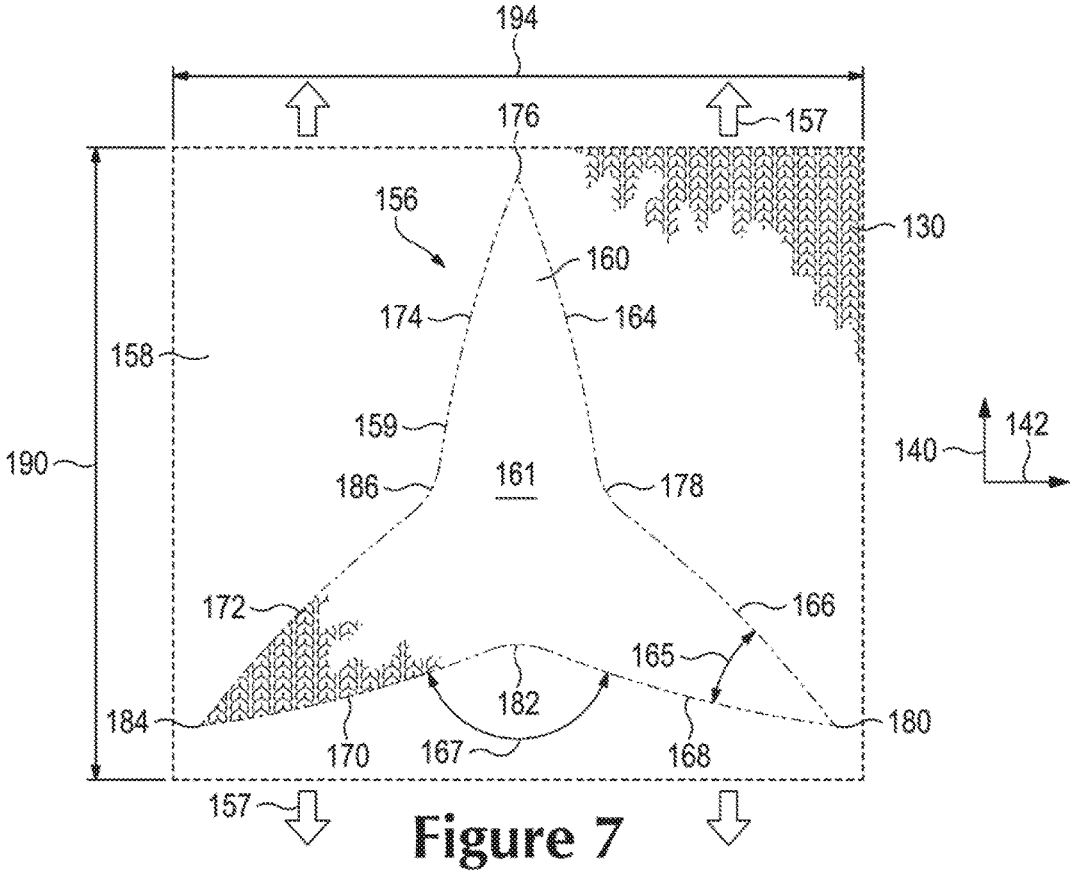
FIG. 7 is a detail view of FIG. 5, wherein the portion of the knitted component is shown in the stretched position.
Figure 9:
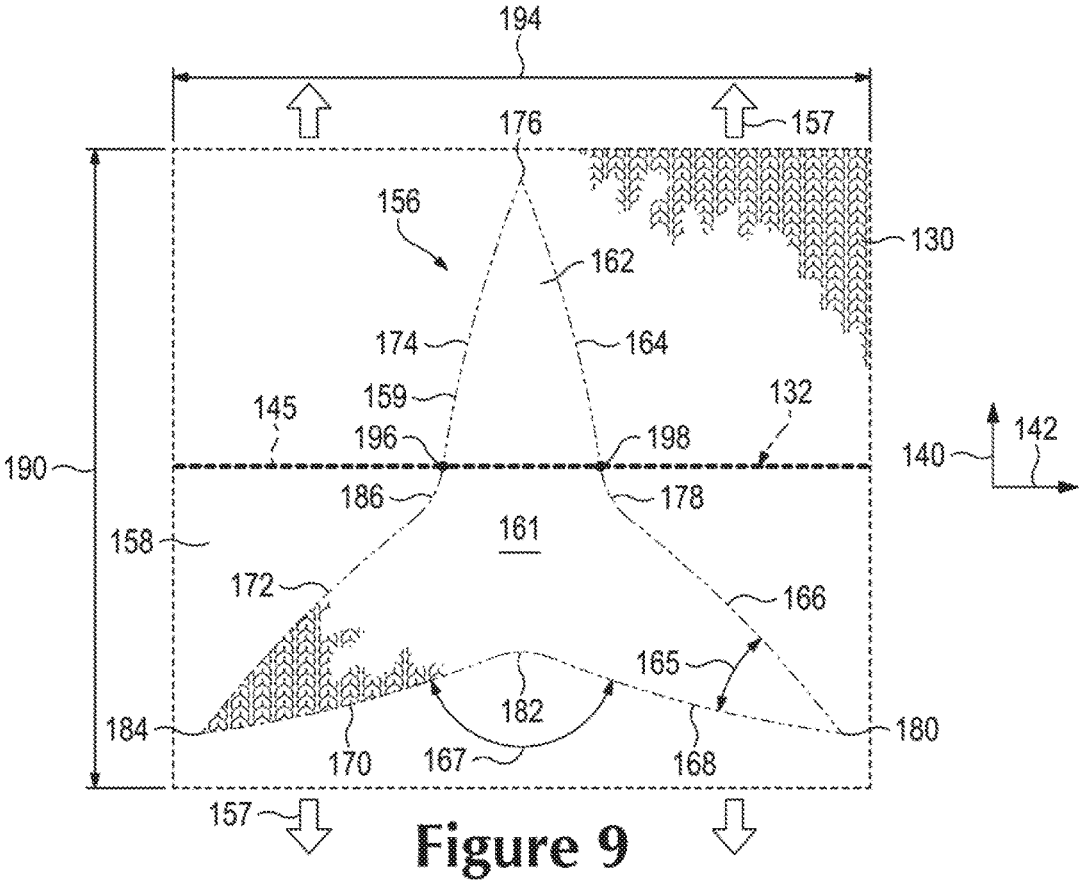
FIG. 9 is a detail view of FIG. 5, wherein the portion of the knitted component is shown in the stretched position.

As knit element 130 stretches from the neutral position of FIGS. 4, 6, and 8 to the stretched position of FIGS. 5, 7, and 9, auxetic portions 156 can deform. The size or area of interior area 161 can increase as knit element 130 stretches.

More specifically, as shown in FIGS. 6 and 7, a representative interior angle 165 is indicated at third vertex 180, between second side 166 and third side 168. A representative exterior angle 167 is indicated at fourth vertex 182, between third side 168 and fourth side 170. By comparing FIGS. 6 and 7, it is apparent that interior angles 165 and/or exterior angles 167 can increase when auxetic portion 156 stretches. As shown in the auxetic portions 156 of FIGS. 6-9, each interior angle 165 and each exterior angle 167 can increase proportionally; however, it will be appreciated that different interior angles 165 and/or different exterior angles 167 can increase disproportionately in some embodiments.

Also, in some embodiments, auxetic portion 156 can deform auxetically as knit element 130 stretches. For example, it is apparent from comparing FIG. 7 to FIG. 6 that auxetic portion 156 enlarges in both the first direction 140 and the second direction 142 as knitted component 100 stretches.

More specifically, as shown in FIGS. 6 and 8, knit element 130 proximate auxetic portion 156 can have a respective unstretched length 188 measured in the first direction 140 and a respective unstretched width 192 measured in the second direction 142. When a stretching force is applied as represented by arrows 157 in FIGS. 7 and 9, knit element 130 can have a stretched length 190 as well as a stretched width 194. Stretched length 190 can be greater than unstretched length 188, and stretched width 194 can be greater than unstretched width 192. Moreover, knit element 130 proximate auxetic portion 156 can define a stretching range. This stretching range can be measured in the first direction 140 as the difference between the stretched length 190 and the unstretched length 188. This stretching range can additionally be measured in the second direction 142 as the difference between the stretched width 194 and the unstretched width 192. In additional embodiments, the stretching range can be measured as the difference between the surface area of the auxetic portion 156 in its stretched position and the surface area of the auxetic portion 156 in its unstretched, neutral position shown in FIG. 6.

Thus, knit element 130 proximate auxetic portion 156 can stretch auxetically due to the stretching force represented by arrows 157. Because of this deformation, as shown in FIG. 5, knit element 130 can bulge in the second direction 142, especially in third region 154, when stretched in the first direction 140. In some embodiments, once the stretching force is reduced, the resiliency of auxetic portions 156 can cause auxetic portions 156 to recover back toward the neutral position of FIGS. 6 and 8. Accordingly, knit element 130 can stretch readily and can be biased to recover back to its unstretched position.

Tensile Strand and Associated Auxetic Portion

As mentioned above, tensile strand 132 can extend across knit element 130. Tensile strand 132 can engage one or more auxetic portions 156. For example, as shown in FIGS. 4 and 8, the plurality of auxetic portions 156 can include a first auxetic portion 162, to which tensile strand 132 is engaged. Also, as shown in FIGS. 4 and 6, the plurality of auxetic portions 156 can include a second auxetic portion 160, and tensile strand 132 can be spaced apart and disengaged from second auxetic portion 160.

As shown in FIG. 8, tensile strand 132 can extend across first auxetic portion 162 primarily in the second direction 142. Tensile strand 132 can intersect border 159 of auxetic portion 162 at a first point 196 and at a second point 198. In some embodiments, first point 196 can be located along sixth side 174, and second point 198 can be located along first side 164. A segment of tensile strand 132 can also extend across interior area 161 of auxetic portion 162 between first point 196 and seconds point 198. It will be appreciated, however, that tensile strand 132 can extend across any suitable portion of auxetic portion 162 without departing from the scope of the present disclosure.

Also, in some embodiments, tensile strand 132 can be inlaid within one or more courses 136 and/or wales 138 that define auxetic portion 162. For example, in some embodiments, tensile strand 132 can be inlaid within a single course 136 defining auxetic portion 162. In other embodiments, tensile strand 132 can extend from one course 136 to another course 136 as it extends across auxetic portion 162. In still other embodiments, tensile strand 132 can be inlaid within one or more wales 138 of auxetic portion 162.

In some embodiments, tensile strand 132 can be fixed to knit element 130 proximate auxetic portion 162. For example, tensile strand 132 can be fixed to knit element 130 proximate border 159. More specifically, in some embodiments, tensile strand 132 can be fixed to knit element 130 proximate first point 196 and/or second point 198. For example, tensile strand 132 can be fixed at point 196 and/or point 198 using adhesives, via a fastener, via a knot, or in another way.

In other embodiments, tensile strand 132 can engage knit element 130 via friction; however, tensile strand 132 can slide along its longitudinal axis relative to first point 196 and/or second point 198 and remain engaged with knit element 130 at first point 196 and/or second point 198. For example, in some embodiments, tensile strand 132 can moveably engage knit element 130 in this manner at first point 196 and second point 198.

Because tensile strand 132 engages knit element 130, for example, proximate auxetic portion 162, tensile strand 132 can be manipulated to alter, move, modify, change, or distort auxetic portion 162. For example, the user can manipulate tensile strand 132 to select and change the area, size, and/or geometry of interior area 161 of auxetic portion 162. In some embodiments, increasing tension of tensile strand 132, for example by pulling on tensile strand 132, can increase the size of interior area 161. In other embodiments, increasing tension of tensile strand 132 can decrease the size of interior area 161. The stretching characteristics of knit element 131, such as the range of stretching or knit element 131, can be related to the size of interior area 161. As such, the stretching characteristics of auxetic portion 156 and, thus, knit element 130 can be changed using tensile strand 132.

Figure 10:
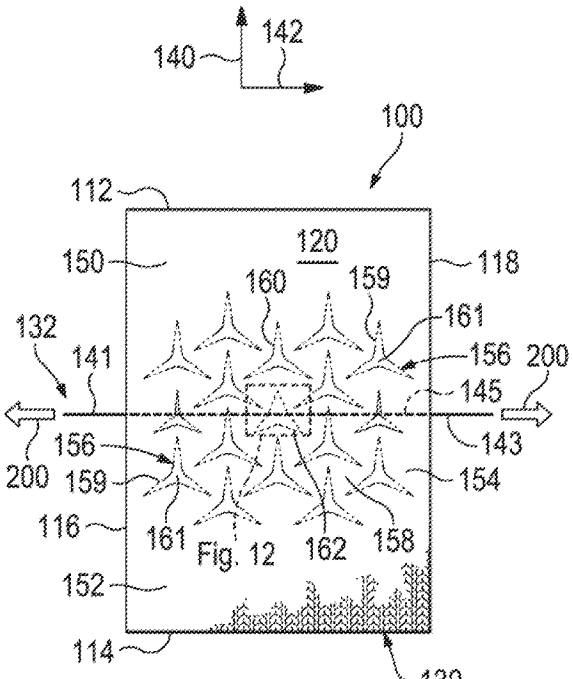
FIG. 10 is a top view of the knitted component of FIG. 1 shown in an adjusted neutral position.
Figure 12:
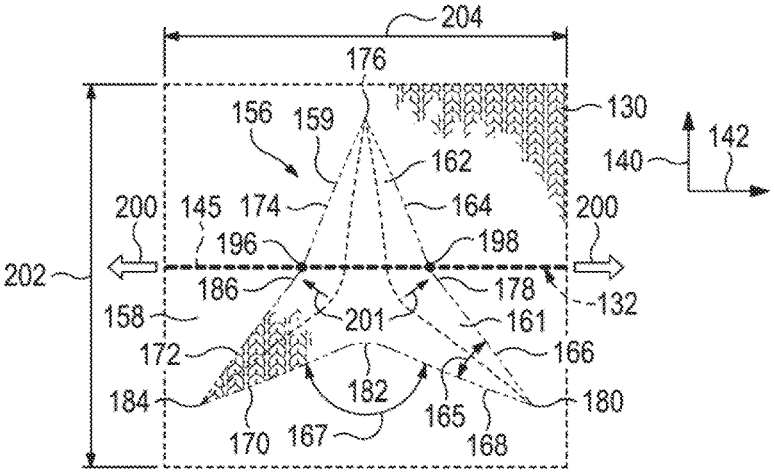
FIG. 12 is a detail view of FIG. 10, wherein the portion of the knitted component is shown in the neutral position.

For example as shown in FIGS. 10 and 12, the user can manipulate tensile strand 132 to alter auxetic portion 162 by pulling first end 141 and second end 143 away from each other as represented by the arrows 200. As such, tensile strand 132 can pull first point 196 and second point 198 of auxetic portion 162 away from each other. For comparison, the original neutral position of auxetic portion 162 is shown with broken lines in FIG. 12. The adjusted neutral position of auxetic portion 162 is shown with solid lines. Arrows 201 represent movement of border 159. Specifically, as shown in FIG. 12, first side 164 and sixth side 174 of auxetic portion 162 can rotate generally about first vertex 176 and move away from each other due to manipulation of tensile strand 132. This can also cause second vertex 178 and sixth vertex 186 to move outward from the center of auxetic portion 162. Thus, by pulling on tensile strand 132, the interior area 161 of auxetic portion 162 can be increased. Moreover, the representative zone of knit element 130 shown in FIG. 12 can have a length 202 and a width 204 as a result of altering auxetic portion 162.

In some embodiments, length 202 and width 204 shown in FIG. 12 can be substantially equal to the original length 188 and width 192, respectively, shown in FIG. 8. Stated differently, in some embodiments, the size of knit element 130 can remain substantially the same despite adjustment of the size of auxetic portion 162. In other embodiments, adjustment of auxetic portion 162 can cause changes to the overall size of knit element 130.

Figure 13:
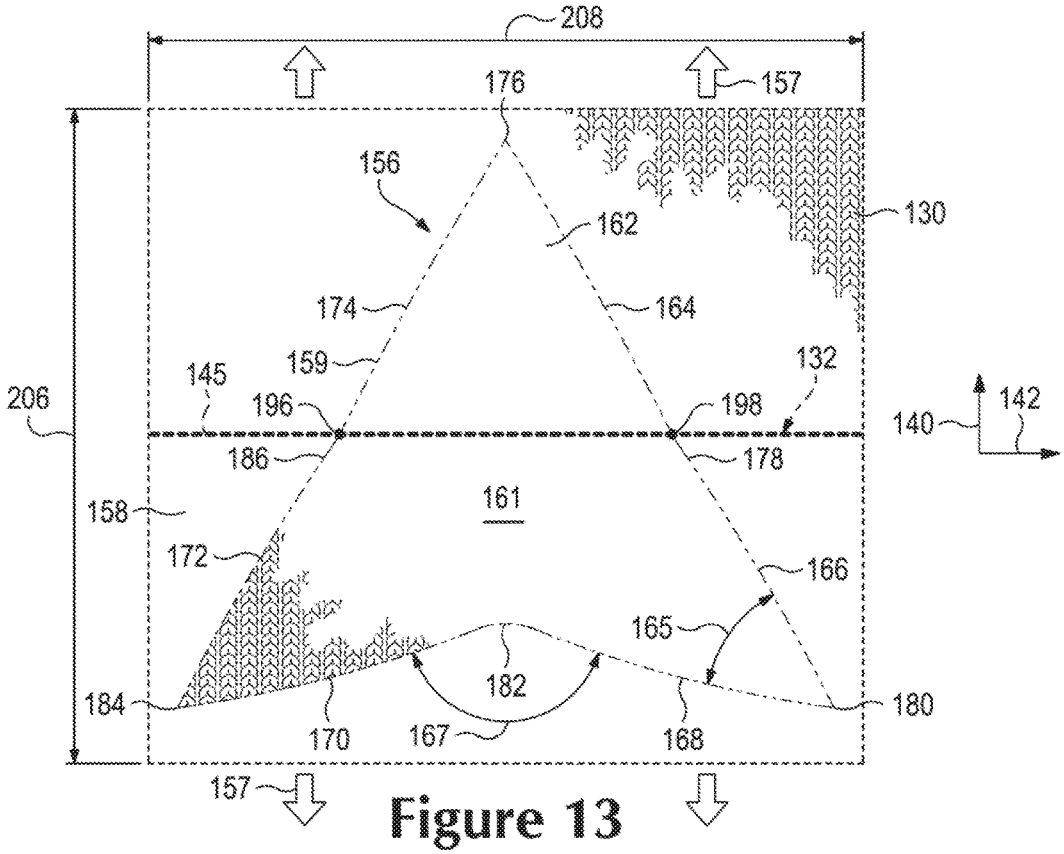
FIG. 13 is a detail view of FIG. 11, wherein the portion of the knitted component is shown in the stretched position.

Stretching of knit element 130 after adjustment of auxetic portion 162 is represented in FIG. 13 according to some embodiments. As shown, when knit element 130 is stretched in the first direction 140 as represented by arrows 157, auxetic portion 162 can elongate from its adjusted length 202 to a stretched length 206, and auxetic portion 162 can widen from its adjusted width 204 to its stretched width 208.

In some embodiments, under the same amount of stretching force (represented by arrows 157), the stretched length 206 of FIG. 13 can be greater than the stretched length 190 of FIG. 9. Likewise, the stretched width 208 of FIG. 13 can be greater than the stretched width 194 of FIG. 9. Thus, it will be appreciated that by increasing the area of interior area 161 of auxetic portion 162 using tensile strand 132, one can increase the stretching range of auxetic portion 162.

Figure 11:
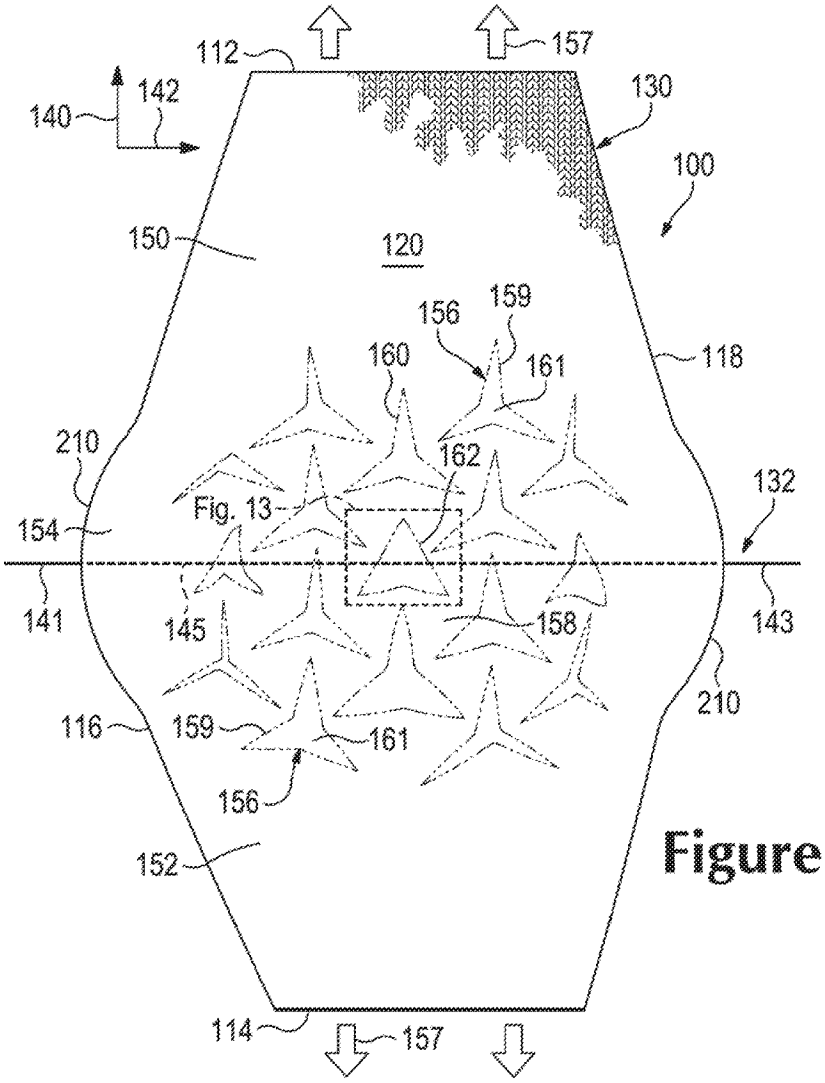
FIG. 11 is a top view of the knitted component of FIG. 10 shown in a stretched position.

Adjusting the stretching characteristics of auxetic portion 162 using tensile strand 132 can cause adjustment to the stretching characteristics of knit element 130. For example, as shown in FIG. 11, third edge 116 and/or fourth edge 118 of knit element 130 can define a convex or bulged region 210 in areas that are proximate auxetic portion 162. In some embodiments, third edge 116 and fourth edge 118 can both define bulged regions 210 when knit element 130 is stretched. Accordingly, tensile strand 132 can be used to increase the stretching range of one or more portions of knit element 130.

In the embodiment of FIGS. 8, 10, and 12, tensile strand 132 is manipulated to increase the size of interior area 161 of auxetic portion 162 when knit element 130 is in a neutral position. As a result, as shown in FIGS. 9, 11, and 13, the stretching range of auxetic portion 162 and knit element 130 is increased. However, it will be appreciated that tensile strand 132 can be used to modify stretching characteristics of auxetic portions 156 and knit element 130 in other ways without departing from the scope of the present disclosure.

For example, in some embodiments, tensile strand 132 can be manipulated to reduce the size of interior area 161 of one or more auxetic portions 156. As a result, the stretching range of knit element 130 can be decreased. Furthermore, in some embodiments, tensile strand 132 can be manipulated to increase the size of interior area 161 of auxetic portion(s) 156, and the stretching range of knit element 130 can be decreased as a result. Additionally, in some embodiments, tensile strand 132 can be manipulated to decrease the size of interior area 161 of auxetic portion(s) 156, and the stretching range of knit element 130 can be increased as a result.

FIGS. 14-17 illustrate an additional embodiment of tensile strand 132 and auxetic portion 162. This embodiment can be substantially similar to the embodiment of FIGS. 8-12, except that tensile strand 132 can be routed across knit element 13 differently.

Figure 14:
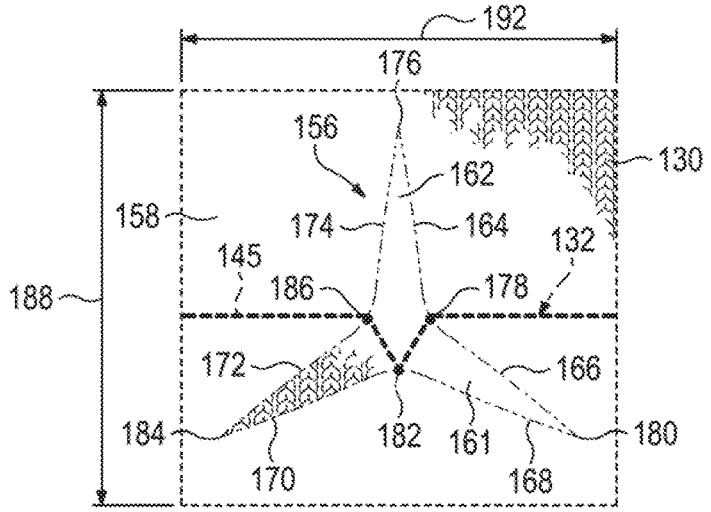
FIG. 14 is a detail view of the knitted component shown in a neutral position according to additional embodiments of the present disclosure.

For example, as shown in FIG. 14, tensile strand 132 can extend across knit element 130 and auxetic portion 162 in both first direction 140 and second direction 142. In some embodiments, tensile strand 132 can zig-zag across auxetic portion 162. Thus, in some embodiments, tensile strand 132 can extend through multiple courses 136 and multiple wales 138 as tensile strand 132 extends across auxetic portion 162 and knit element 130.

Additionally, tensile strand 132 can engage knit element 130 proximate second vertex 178, fourth vertex 182, and sixth vertex 186 of auxetic portion 162 as shown in the embodiment of FIG. 14. Tensile strand 132 can be fixed to one or more of these vertices in some embodiments. Also, in some embodiments, tensile strand 132 can be engaged to one or more of these vertices as a result of being inlaid within knit element 130 proximate these vertices. However, tensile strand 132 can move (e.g., slide along its longitudinal axis) relative to these vertices in some embodiments.

Specifically, in some embodiments, tensile strand 132 can be fixed to fourth vertex 182, and tensile strand 132 can be inlaid in second and sixth vertices 178, 186. As such, tensile strand 132 can move relative to second and sixth vertices 178, 186. Thus, tensile strand 132 can be fixed to knit element 130 at fourth vertex 182, and tensile strand 132 can be moveably engaged with knit element 130 at second and sixth vertices 178, 186.

Figure 15:
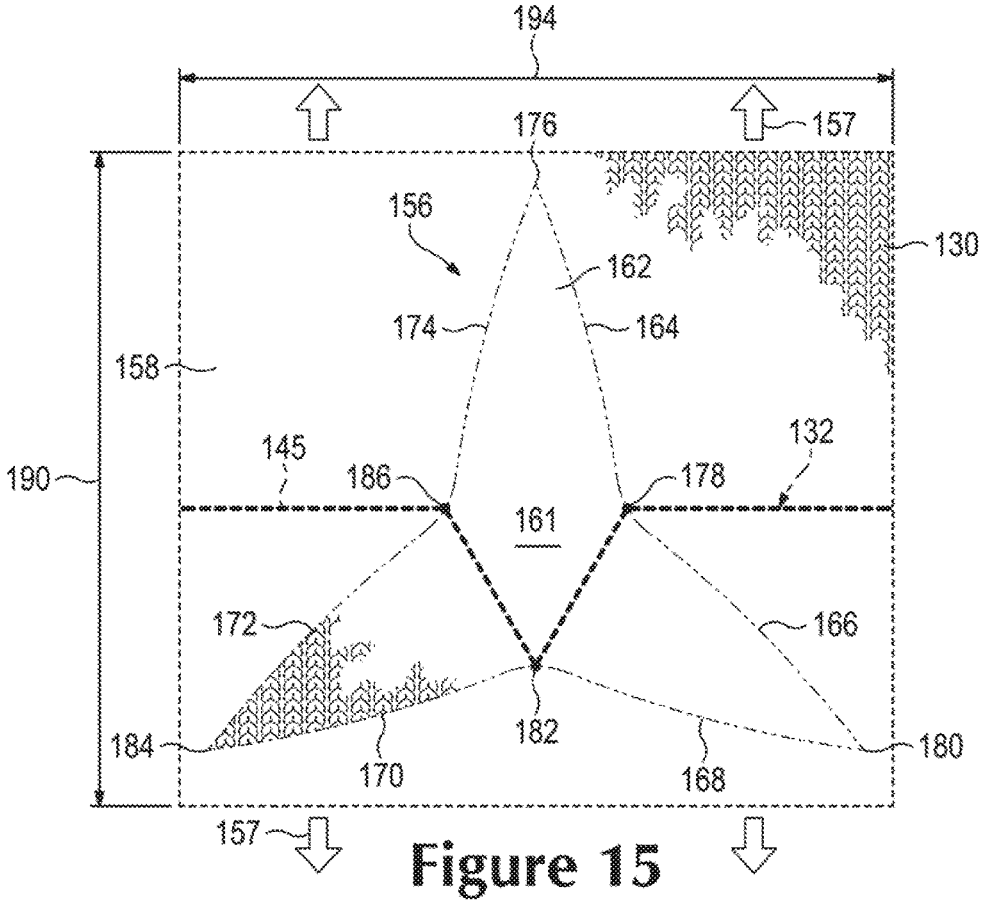
FIG. 15 is a detail view of the knitted component of FIG. 14 shown in a stretched position.

FIG. 15 illustrates auxetic portion 162 when knit element 130 is stretched as represented by arrows 157. As shown, auxetic portion 162 can stretch in a manner that is substantially similar to the embodiment of FIG. 9.

Figure 16:
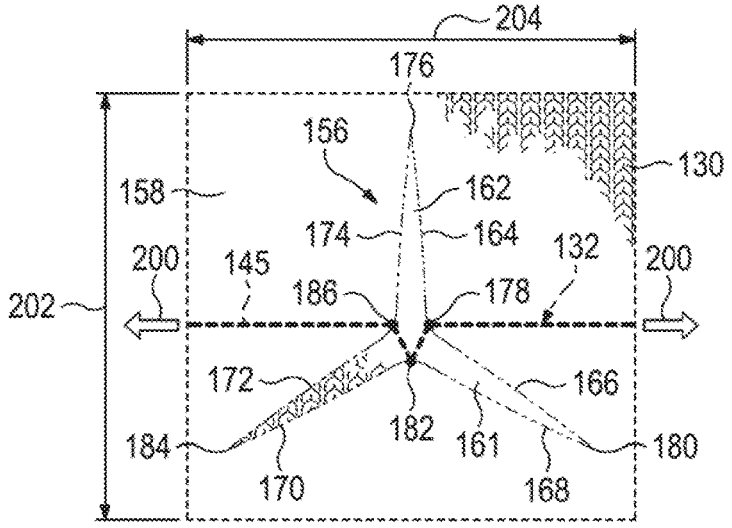
FIG. 16 is a detail view of the knitted component of FIG. 14 shown in an adjusted neutral position.

As shown in FIG. 16, ends of tensile strand 132 can be pulled as represented by arrows 200. As a result, tensile strand 132 can pull second vertex 178, fourth vertex 182, and sixth vertex 186 inward toward each other as represented by arrows 212 in FIG. 16. Thus, the size of interior area 161 can be reduced by pulling ends of tensile strand 132.

Figure 17:
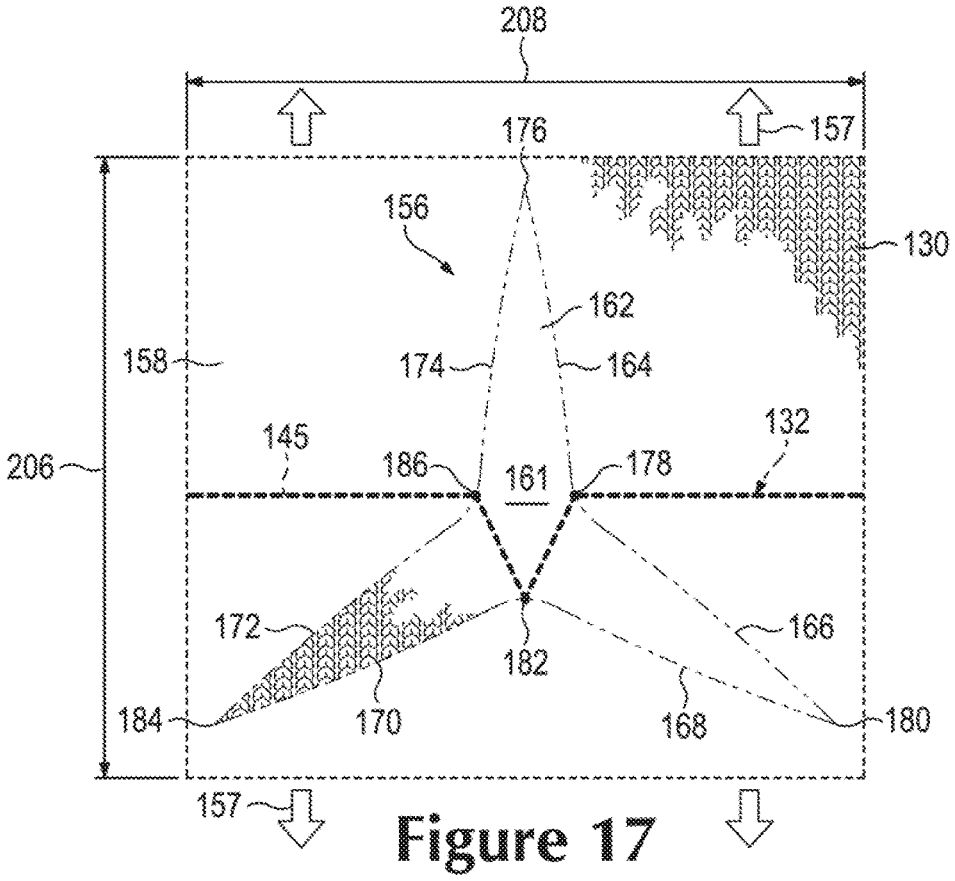
FIG. 17 is a detail view of the knitted component of FIG. 16 shown in a stretched position.

When knit element 130 is stretched in the first direction 140 as represented by arrows 157 in FIG. 17, auxetic portion 162 can stretch and enlarge. However, by comparing FIG. 15 and FIG. 17 it becomes apparent that the adjusted stretched length 206 can be less than the original stretched length 190. Likewise, the adjusted stretched width 208 can be less than the original stretched width 194.

Accordingly, tensile strand 132 can be used for adjusting the size of auxetic portion 162. In some embodiments, tensile strand 132 can be pulled to make auxetic portion 162 larger or smaller, depending on how tensile strand 132 engages auxetic portion 162. As a result, the stretching behavior of knit element 130 can be selected. In some embodiments, such as those embodiments of FIGS. 11 and 13, knit element 130 can have an increased range of stretching due to adjustments to the size of auxetic portion 162. In other embodiments, such as the embodiment of FIG. 17, knit element 130 can have a decreased range of stretching due to adjustments to the size of auxetic portion 162.

In some embodiments, after auxetic portion 162 has been adjusted using tensile strand 132, tensile strand 132 can be secured relative to knit element 130 such that auxetic portion 162 remains at its adjusted, neutral size. For example, first end 141 and/or second end 143 can be secured at a fixed location relative to tensile strand 132 for maintaining tension in tensile strand 132 and maintaining auxetic portion 162 at its adjusted size. In some embodiments, first end 141 and second end second end 143 can be secured directly together, for example in a knot, to maintain set tension in tensile strand 132. In additional embodiments, a fastener, a spool, or other object can be included for detachably securing to tensile strand 132 to maintain the selected tension in tensile strand 132. Moreover, in some embodiments, when tensile strand 132 is released, the resiliency of knit element 130 can cause auxetic portion 162 to recover to its original, neutral, and unstretched size.

Article of Footwear with Adjustable Auxetic Portion

Various objects and articles can be constructed that include knitted components of the type discussed above. For example, as shown in FIGS. 18-21, a knitted component 1030 for an article of footwear 1000 is illustrated according to exemplary embodiments.

Figure 18:
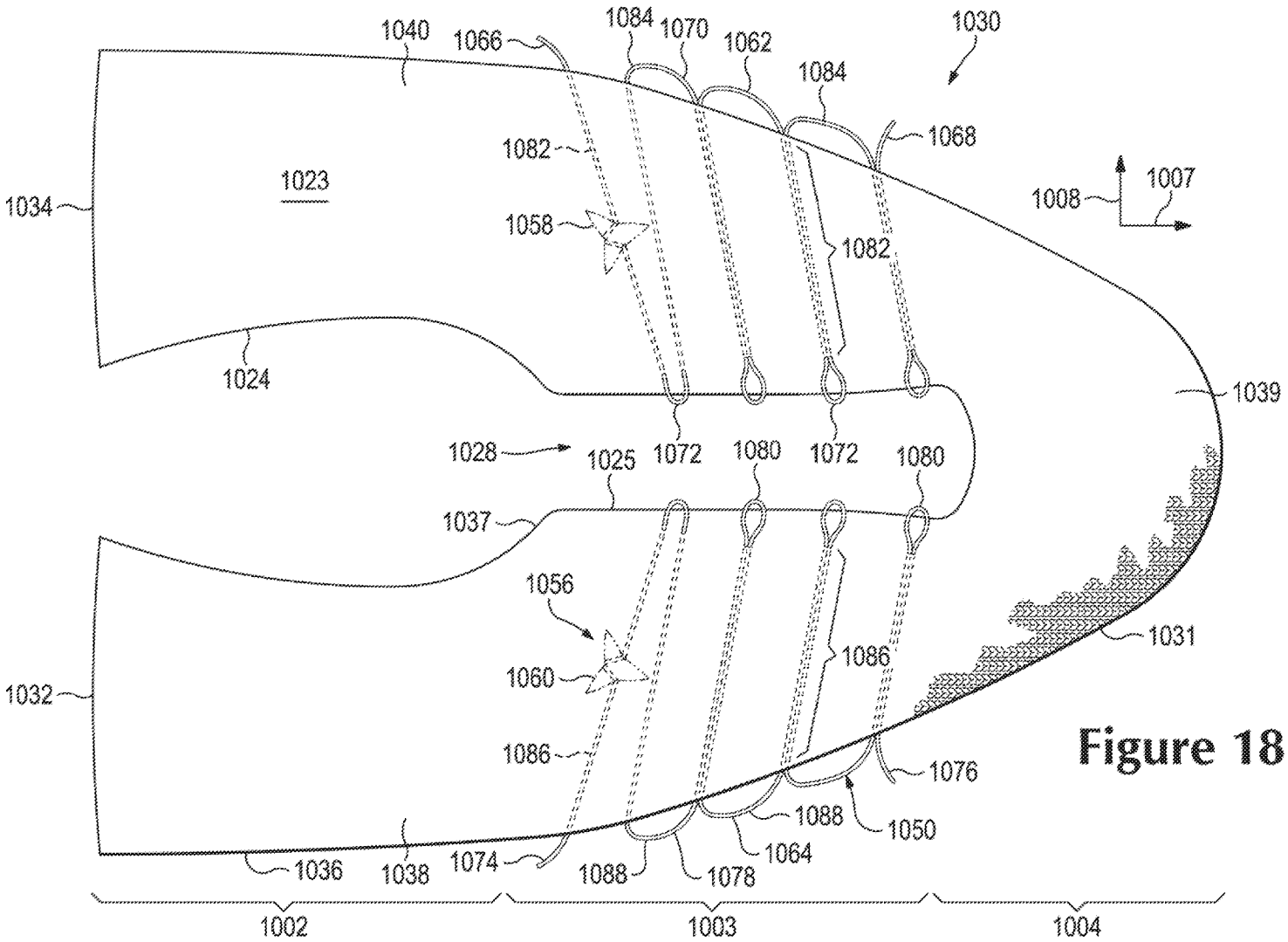
FIG. 18 is a plan view of a knitted component for an article of footwear according to additional embodiments of the present disclosure.
Figure 19:
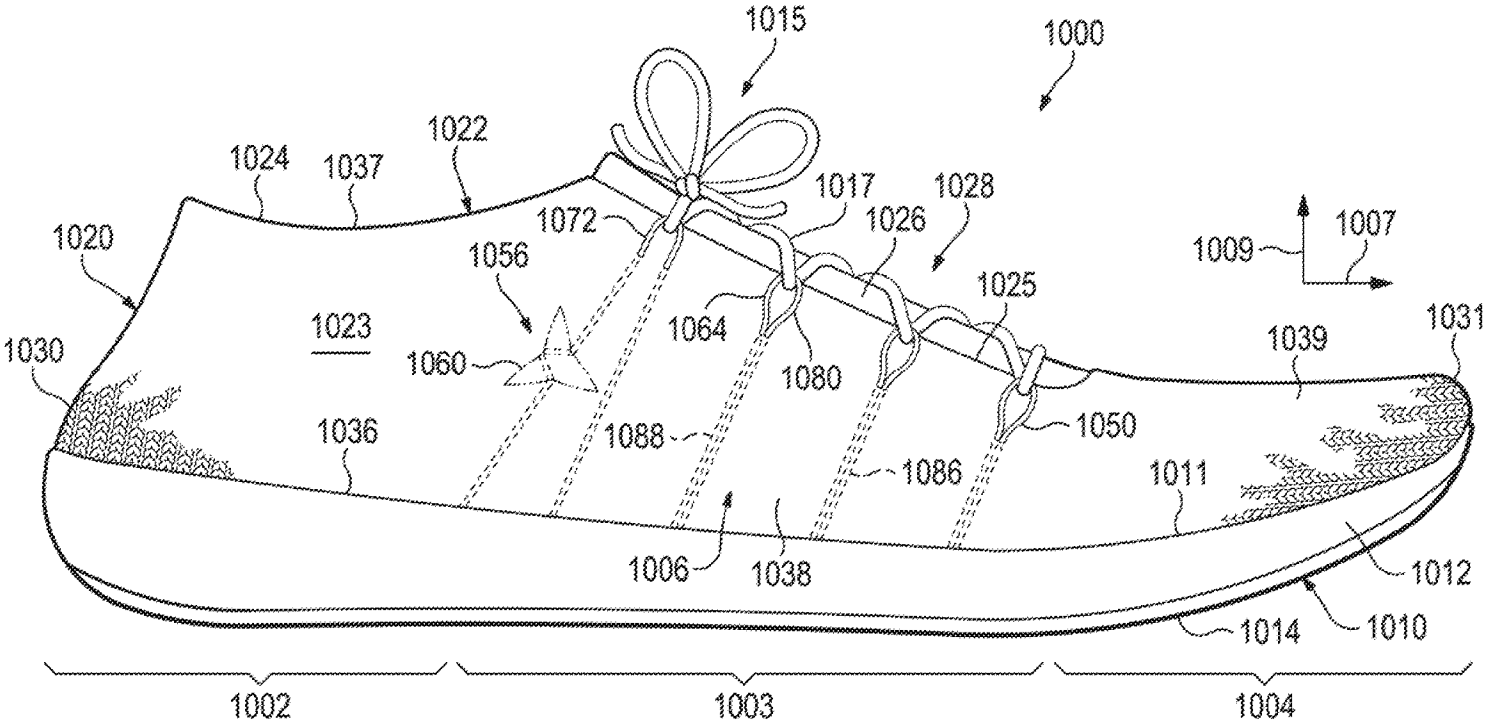
FIG. 19 is a lateral view of an article of footwear with the knitted component of FIG. 18.
Figure 20:
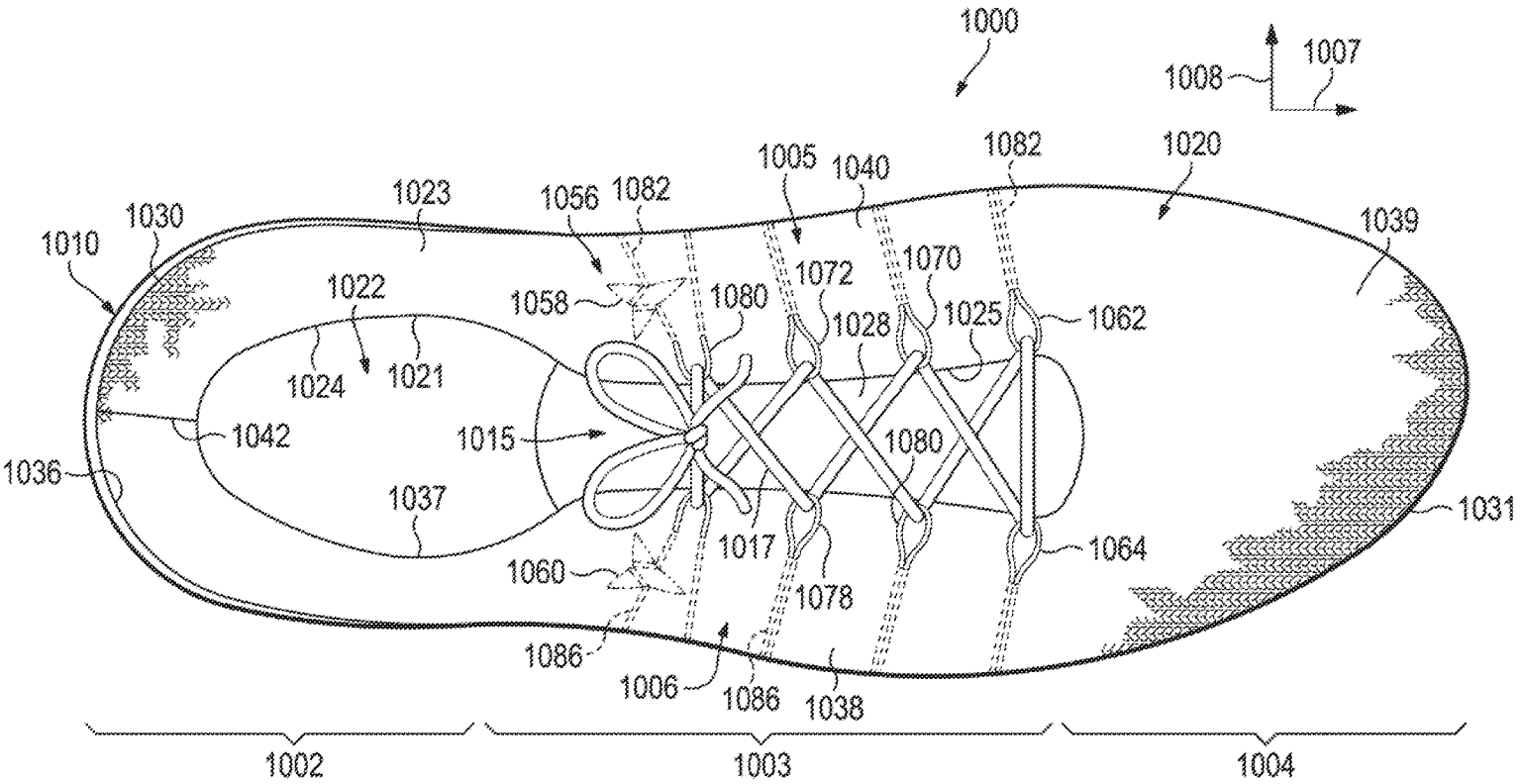
FIG. 20 is a top view of the article of footwear of FIG. 19 shown in a neutral position.
Figure 21:
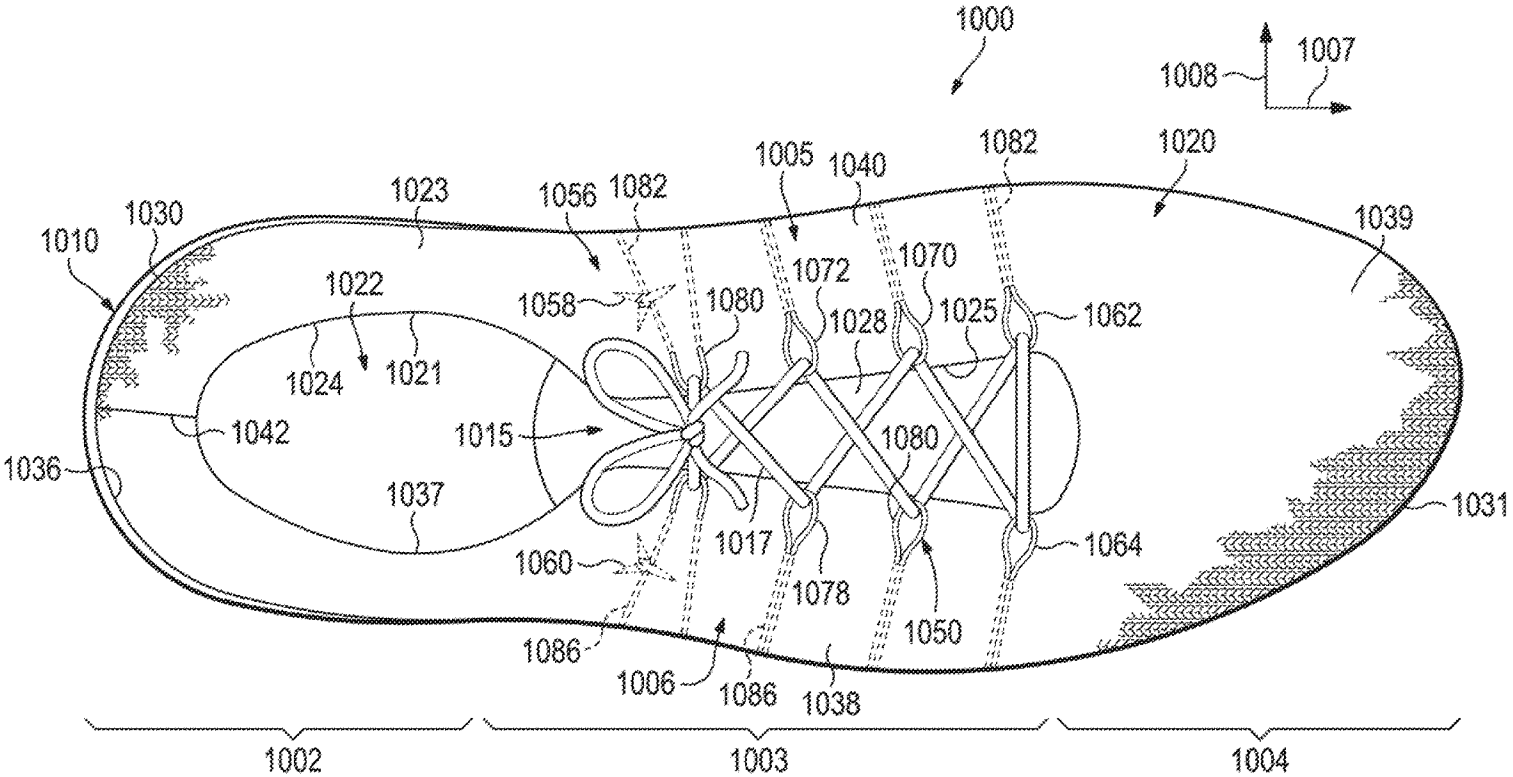
FIG. 21 is a top view of the article of footwear of FIG. 20 shown in an adjusted neutral position.

As shown in FIGS. 19-21, footwear 1000 can generally include a sole structure 1010 and an upper 1020. Upper 1020 can include a knitted component 1030. Knitted component 1030 is shown independently in FIG. 18 and is shown associated with sole structure 1010 and other features in FIGS. 19-21. As will be discussed, knitted component 1030 can include one or more features described above with respect to FIGS. 1-17. Thus, knitted component 1030 can include one or more auxetic portions, and at least one of those auxetic portions can be adjustable.

For reference purposes, footwear 1000 may be divided into three general regions: a heel region 1002, a midfoot region 1003, and a forefoot region 1004. Heel region 1002 can generally include portions of footwear 1000 corresponding with rear portions of the wearer's foot, including the heel and calcaneus bone. Midfoot region 1003 can generally include portions of footwear 1000 corresponding with middle portions of the wearer's foot, including an arch area. Forefoot region 1004 can generally include portions of footwear 1000 corresponding with forward portions of the wearer's foot, including the toes and joints connecting the metatarsals with the phalanges.

Footwear 1000 can also include a medial side 1005 and a lateral side 1006. Medial side 1005 and lateral side 1006 can extend through forefoot region heel region 1002, midfoot region 1003, and forefoot region 1004 in some embodiments. Medial side 1005 and lateral side 1006 can correspond with opposite sides of footwear 1000. More particularly, lateral side 1006 can correspond with an outside area of the wearer's foot (i.e., the surface that faces away from the other foot), and medial side 1005 can correspond with an inside area of the wearer's foot (i.e., the surface that faces toward the other foot). Heel region 1002, midfoot region 1003, forefoot region 1004, medial side 1005, and lateral side 1006 are not intended to demarcate precise areas of footwear 1000. Rather, heel region 1002, midfoot region 1003, forefoot region 1004, medial side 1005, and lateral side 1006 are intended to represent general areas of footwear 1000 to aid in the following discussion.

Footwear 1000 can also extend along various directions. For example, footwear 1000 can extend along a longitudinal direction 1007, a transverse direction 1008, and a vertical direction 1009. Longitudinal direction 1007 can extend generally between heel region 1002 and forefoot region 1004. Transverse direction 1008 can extend generally between medial side 1005 and lateral side 1006. Also, vertical direction 1009 can extend substantially perpendicular to both longitudinal direction 1007 and transverse direction 1008. It will be appreciated that longitudinal direction 1007, transverse direction 1008, and vertical direction 1009 are merely included for reference purposes and to aid in the following discussion.

Embodiments of sole structure 1010 will now be discussed with reference to FIG. 19. Sole structure 1010 can include an upper surface 1011 that is attached to upper 1020 and can include a lower surface 1013 that faces away from upper 1020 and that defines a ground engaging surface of sole structure 1010. In some embodiments, sole structure 1010 can include a midsole 1012 and an outsole 1014. Midsole 1012 can include a resiliently compressible material, fluid-filled bladders, and the like. As such, midsole 1012 can cushion the wearer's foot and attenuate impact and other forces when running, jumping, and the like. Midsole 1012 can at least partially define upper surface 1011 of sole structure 1010. Outsole 1014 can be secured to the midsole 1012 and can include a wear resistant material, such as rubber and the like. Outsole 1014 can also include tread and other traction-enhancing features. Outsole 1014 can define the lower surface 1013 of sole structure 1010.

Also, in some embodiments, sole structure 1010 can include one or more auxetic portions that allow sole structure 1010 to stretch and deform auxetically. For example, in some embodiments, sole structure 1010 and/or other aspects of footwear 1000 can include features disclosed in U.S. patent application Ser. No. 14/470,067, entitled "Auxetic Sole With Upper Cabling", the disclosure of which is incorporated by reference in its entirety.

Embodiments of upper 1020 will now be discussed with reference to FIGS. 19-21. As shown, upper 1020 can define a void 1022 that receives a foot of the wearer. Stated differently, upper 1020 can define an interior surface 1021 that defines void 1022, and upper 1020 can define an exterior surface 1023 that faces in a direction opposite interior surface 1021. When the wearer's foot is received within void 1022, upper 1020 can at least partially enclose and encapsulate the wearer's foot. Thus, upper 1020 can extend about heel region 1002, midfoot region 1003, forefoot region 1004, medial side 1005, and lateral side 1006 in some embodiments.

Upper 1020 can include a main opening 1024 that provides access into and out of void 1022. Upper 1020 can also include a throat 1028. Throat 1028 can extend from collar main opening 1024 toward forefoot region 1004. Throat 1028 dimensions can be varied to change the width of footwear 1000 between medial side 1005 and lateral side 1006. Thus, throat 1028 can affect fit and comfort of article of footwear 1000.

In some embodiments, such as the embodiment of FIGS. 19-21, throat 1028 can be an "open" throat 1028, in which upper 1020 includes a throat opening 1025 that extends from main opening 1024 toward forefoot region 1004 and that is defined between medial side 1005 and lateral side 1006. In other embodiments, throat 1028 can be a "closed" throat 1028, in which upper 1020 is substantially continuous and uninterrupted between medial side 1005 and lateral side 1006.

Additionally, throat 1028 can include a tongue 1026 that is disposed within throat opening 1025. For example, in some embodiments, tongue 1026 can be attached at its forward end to forefoot region 1004, and tongue 1026 can be detached from medial side 1005 and lateral side 1006. Accordingly, tongue 1026 can substantially fill throat opening 1025.

Article of footwear 1000 can further include a securing member 1015 for selectively adjusting the fit of footwear 1000 on the wearer's foot. In some embodiments, securing member 1015 can include a shoelace 1017. However, it will be appreciated that securing member 1015 can include a strap, a buckle, hook-and-loop tape, buttons, or other types of members that allow for selecting how tightly footwear 1000 fits to the wearer's foot. As shown in the embodiment of FIGS. 19-21, shoelace 1017 can extend back and forth between medial side 1005 and lateral side 1006 and can be secured to both. Thus, by changing tension of shoelace 1017, the girth of upper 1020 in the transverse direction 1008 can be adjusted. Also, once the fit is desirable, the user can tie shoelace 1017 into a knot to secure footwear 1000 in the selected configuration.

Many conventional footwear uppers are formed from multiple material elements (e.g., textiles, polymer foam, polymer sheets, leather, synthetic leather) that are joined through stitching or bonding, for example. In contrast, at least a portion of upper 1020 is formed and defined by knitted component 1030. Knitted component 1030 can be formed of unitary knit construction.

In some embodiments, knitted component 1030 can define at least a portion of the void 1022 within upper 1020. Also, in some embodiments, knitted component 1030 can define at least a portion of exterior surface 1023. Furthermore, in some embodiments, knitted component 1030 can define at least a portion of interior surface 1021 of the upper 1020. Additionally, in some embodiments, knitted component 1030 can define a substantial portion of heel region 1002, midfoot region 1003, forefoot region 1004, medial side 1005, and lateral side 1006 of upper 1020. Thus, knitted component 1030 can encompass the wearer's foot in some embodiments. Also, in some embodiments, knitted component 1030 can compress the wearer's foot to secure to the wearer's foot.

Thus, upper 1020 can be constructed with a relatively low number of material elements. This can decrease waste while also increasing the manufacturing efficiency and recyclability of upper 1020. Additionally, knitted component 1030 of upper 1020 can incorporate a smaller number of seams or other discontinuities. This can further increase manufacturing efficiency of footwear 1000. Moreover, interior surface 1021 of upper 1020 can be substantially smooth and uniform to enhance the overall comfort of footwear 1000.

Features of knitted component 1030 will now be discussed in greater detail according to various embodiments. Knitted component 1030 can generally include a knit element 1031. Knit element 1031 can correspond to knit element 130 discussed above in relation to FIGS. 1-17. Knitted component 1030 can also generally include at least one tensile strand 1050. Tensile strand 1050 can correspond to tensile strand 132 discussed above in relation to FIGS. 1-17. Knit element 1031 and tensile strand 1050 can be formed of unitary knit construction.

Knit element 1031 will now be discussed in greater detail with reference to FIG. 18. Knit element 1031 can define a majority of knitted component 1030 and upper 1020 in some embodiments.

Knit element 1031 can include a lateral portion 1038 and a medial portion 1040. Lateral portion 1038 can define lateral side 1006 of upper 1020 and can be configured to cover over and lie against a lateral area of the wearer's foot. Furthermore, medial portion 1040 can define medial side 1005 of upper 1020 and can be configured to cover over and lie against a medial area of the wearer's foot. As shown in FIG. 18, lateral portion 1038 and medial portion 1040 can be joined at a forward portion 1039 of knit element 1031. Forward portion 1039 can define forefoot region 1004 of upper 1020 and can be configured to cover over the wearer's toes, metatarsals, and adjacent areas of the foot. Moreover, lateral potion 1038 can include a lateral rear edge 1032 and medial portion 1040 can include a medial rear edge 1034. Furthermore, knit element 1031 can include an outer peripheral edge 1036 and an inner peripheral edge 1037. Outer peripheral edge 1036 can extend from lateral rear edge 1032, along lateral portion 1038, along forward portion 1039, and along medial potion 1040 to terminate at medial rear edge 1034. Inner peripheral edge 1037 can similarly extend from lateral rear edge 1032, along lateral portion 1038, along forward portion 1039, and along medial portion 1040 to terminate at medial rear edge 1034.

When knit element 1031 is assembled to define upper 1020, rear edge 1032 and rear edge 1034 can be joined together to define a seam 1042 in heel region 1002 as shown in FIGS. 20 and 21. Also, inner peripheral edge 1037 can define main opening 1024 and throat opening 1025. Furthermore, outer peripheral edge 1036 can be disposed proximate to sole structure 1010. In some embodiments, outer peripheral edge 1036 can be covered over by sole structure 1010. Furthermore, in some embodiments, a strobel can be attached to outer peripheral edge 1036, and the strobel and can overlap and attach to upper surface 1011 of sole structure 1010 such that outer peripheral edge 1036 is proximate sole structure 1010.

In some embodiments, tongue 1026 can be a part that is independent of knit element 1031. Tongue 1026, for example, can be attached via stitching, adhesives, fasteners, or other connecting device to forward portion 1039 of knit element 1031. In other embodiments, tongue 1026 can be integrally attached to forward portion 1039, medial portion 1040, or lateral portion 1038 of knit element 1031.

As shown in FIGS. 18-21, knit element 1031 can further include one or more auxetic portions 1056. It will be appreciated that knit element 1031 can include any number of auxetic portions 1056. Auxetic portions 1056 can also have any suitable shape. Moreover, auxetic portions 1056 can be disposed in any suitable location on knit element 1031. Auxetic portions 1056 can increase stretchability of knit element 1031 and upper 1020. Thus, auxetic portions 1056 can be provided in locations of upper 1020 where increased stretchability is desired. This stretchability can allow upper 1020 to better accommodate and conform to the contoured surfaces of the foot. Stretching of auxetic portions 1056 an also allow the wearer's foot to more easily flex inside upper 1020 while upper 1020 maintains a comfortable and supportive fit.

Auxetic portions 1056, in some embodiments, can correspond to auxetic portions 156 described above with respect to FIGS. 1-17. Thus, auxetic portions 1056 can generally have a shape of a so-called re-entrant triangle. However, auxetic portions 1056 can have a different shape without departing from the scope of the present disclosure.

In some embodiments, auxetic portions 1056 of knit element 1031 can include a medial auxetic portion 1058 and a lateral auxetic portion 1060. In some embodiments, medial auxetic portion 1058 can be disposed in medial portion 1040 of knit element 1031, and lateral auxetic portion 1060 can be disposed in lateral portion 1038. Also, in some embodiments, medial and lateral auxetic portions 1058, 1060 can be disposed in midfoot region 1003. Furthermore, medial and lateral auxetic portions 1058, 1060 can be spaced apart at a distance from outer edge 1036 and inner peripheral edge 1037. Additionally, in some embodiments, medial and lateral auxetic portions 1058, 1060 can partially define respective portions of interior surface 1021 and exterior surface 1023 of upper 1020.

As such, auxetic portions 1056 can allow for a high degree of stretching of upper 1020, especially in the midfoot region 1003 on medial side 1005 and lateral side 1006. For example, flexure of the wearer's foot can cause a stretching force to be applied to upper 1020 in the longitudinal direction 1007. As a result, areas of upper 1020 proximate auxetic portions 1056 can stretch in the longitudinal direction 1007. Also, as a result of the auxetic nature of upper 1020, this longitudinal stretching can cause areas of upper 1020 proximate auxetic portions 1056 to stretch in the transverse direction 1008 and/or the vertical direction 1009 as well.

Moreover, like the embodiments described above with respect to FIGS. 1-17, the size of auxetic portions 1056 can be adjusted in a selective manner using tensile strand 1050. By adjusting the size of auxetic portions 1056, the stretching characteristics of upper 1020 can be selected and varied. For example, in embodiments similar to FIGS. 14-17, manipulation of tensile strand 1050 can reduce the size of auxetic portion 1056 to reduce the range of stretching of knitted component 1030 and upper 1020. In other embodiments similar to FIGS. 8-13, manipulation of tensile strand 1050 can increase the size of auxetic portion 1056 to increase the range of stretching of knitted component 1030 and upper 1020.

It will be appreciated that knitted component 1030 can include any number of tensile strands 1050. Also, tensile strands 1050 can be routed through any suitable area of knit element 1031.

In some embodiments represented in FIG. 18, knitted component 1030 can include a medial tensile strand 1062, which extends across knit element 1031 generally within medial portion 1040. Knitted component 1030 can further include a lateral tensile strand 1064, which extends across knit element 1031 generally within lateral portion 1038.

As shown in FIG. 18, medial tensile strand 1062 can include a first end 1066, a second end 1068, and a middle section 170. In the embodiment illustrated, medial tensile strand 1062 zigs-zags between outer peripheral edge 1036 and inner peripheral edge 1037 of medial portion 1040 as it extends generally in the longitudinal direction 1007. Also, second end 1068 can be disposed forward of the first end 1066 in the longitudinal direction 1007. The first end 1066 can be disposed in midfoot region 1003 while second end 1068 can be disposed proximate to forward portion 1039 of knit element 1031. Moreover, middle section 1070 of medial tensile strand 1062 can extend continuously between first end 1066 and second end 1068.

Furthermore, portions of medial tensile strand 1062 can be exposed from knit element 1031 while other portions of medial tensile strand 1062 can be enclosed, inlaid, or otherwise covered by knit element 1031. For example, in some embodiments, first end 1066, second end 1068, and/or portions of middle section 1070 can be exposed from knit element 1031. Also, portions of middle section 1070 can be enclosed, inlaid, or otherwise covered by knit element 1031.

In some embodiments, middle section 1070 of medial tensile strand 1062 can define a plurality of transverse sections 1082 that extend generally in the transverse direction 1008 as shown in FIG. 18. Transverse sections 1082 can be inlaid within knit element 1031 in some embodiments.

Also, middle section 1070 can define a plurality of medial lace loops 1072. Medial lace loops 1072 can extend between adjacent transverse sections 1082 and can be exposed from knit element 1031. Also, medial lace loops 1072 can be disposed adjacent inner peripheral edge 1037 of medial portion 1040. As shown in FIGS. 19-21, shoelace 1017 can be received within medial lace loops 1072 to secure shoelace 1017 to medial side 1005 of upper 1020.

Furthermore, as shown in FIG. 18, middle section 1070 of medial tensile strand 1062 can define a plurality of outer sections 1084. Outer sections 1084 can extend between adjacent transverse sections 1082. In other embodiments, one or more outer sections 1084 can terminate proximate outer peripheral edge 1036. Outer sections 1084 can extend from and can be exposed from outer peripheral edge 1036. As represented in FIGS. 19-21, when knit element 1031 is assembled and attached to sole structure 1010, outer sections 1084 can be attached and fixed to sole structure 1010.

Accordingly, in some embodiments, medial tensile strand 1062 can provide support and/or stretch resistance to medial side 1005 of article of footwear 1000, especially in the vertical direction 1009. Also, medial tensile strand 1062 can attach shoelace 1017 to upper 1020.

Similarly, lateral tensile strand 1064 can include a first end 1074, a second end 1076, and a middle section 178. In the embodiment illustrated, lateral tensile strand 1064 zigs-zags between outer peripheral edge 1036 and inner peripheral edge 1037 of lateral portion 1038 as it extends generally in the longitudinal direction 1007. Also, second end 1076 can be disposed forward of the first end 1074 in the longitudinal direction 1007. The first end 1074 can be disposed in midfoot region 1003 while second end 1076 can be disposed proximate to forward portion 1039 of knit element 1031. Moreover, middle section 1078 of lateral tensile strand 1064 can extend continuously between first end 1074 and second end 1076.

Furthermore, portions of lateral tensile strand 1064 can be exposed from knit element 1031 while other portions of lateral tensile strand 1064 can be enclosed, inlaid, or otherwise covered by knit element 1031. For example, in some embodiments, first end 1074, second end 1076, and/or portions of middle section 1078 can be exposed from knit element 1031. In other words, first end 1074, second end 1076, and/or portions of middle section 1078 can define "exposed segments" of tensile strand 1064. Also, portions of middle section 1078 can be enclosed, inlaid, or otherwise covered by knit element 1031. In other words, middle section 1078 can define "inlaid segments" of tensile strand 1064.

In some embodiments, middle section 1078 of lateral tensile strand 1064 can define a plurality of transverse sections 1086 that extend generally in the transverse direction 1008 as shown in FIG. 18. Transverse sections 1086 can be inlaid within knit element 1031 in some embodiments.

Also, middle section 1078 can define a plurality of lateral lace loops 1080. Lateral lace loops 1080 can extend between adjacent transverse sections 1086 and can be exposed from knit element 1031. Also, lateral lace loops 1080 can be disposed adjacent inner peripheral edge 1037 of lateral portion 1038. As shown in FIGS. 19-21, shoelace 1017 can be received within lateral lace loops 1080 to secure shoelace 1017 to lateral side 1006 of upper 1020.

Furthermore, as shown in FIG. 18, middle section 1078 of lateral tensile strand 1064 can define a plurality of outer sections 1088. Outer sections 1088 can extend between adjacent transverse sections 1086. In other embodiments, one or more outer sections 1088 can terminate proximate outer peripheral edge 1036. Outer sections 1088 can extend from and can be exposed from outer peripheral edge 1036. As represented in FIGS. 19-21, when knit element 1031 is assembled and attached to sole structure 1010, outer sections 1088 can be attached and fixed to sole structure 1010.

Accordingly, in some embodiments, lateral tensile strand 1064 can provide support and/or stretch resistance to lateral side 1006 of article of footwear 1000, especially in the vertical direction 1009. Also, lateral tensile strand 1064 can attach shoelace 1017 to upper 1020.

In some embodiments, tensile strands 1050 can engage auxetic portions 1056, and tensile strands 1050 can be manipulated for adjusting the size of auxetic portions 156. For example, in some embodiments, medial tensile strand 1062 can engage medial auxetic portion 1058, and lateral tensile strand 1064 can engage lateral auxetic portion 1060.

As shown in the embodiment of FIGS. 18-21, tensile strands 1050 can engage auxetic portions 1056 similar to the embodiment of FIGS. 14-17. As such, tensile strands 1050 can engage the internal vertices of auxetic portions 1056. However, it will be appreciated that tensile strands 1050 can engage auxetic portions 1056 similar to the embodiment of FIGS. 8-13 in other embodiments. Additionally, tensile strands 1050 can engage other areas of auxetic portions 1056 without departing from the scope of the present disclosure.

Accordingly, by pulling or otherwise manipulating tensile strand 1050, the user can change the size of auxetic portions 1056. For example, with regard to knitted component of FIG. 18, the first end 1066 of medial tensile strand 1062 can be pulled to reduce the size of medial auxetic portion 1058 in some embodiments. Similarly, the first end 1074 of lateral tensile strand 1064 can be pulled to reduce the size of lateral auxetic portion 1060 in some embodiments.

In other situations where sole structure 1010 is attached, the user can pull the rearmost medial lace loop 1072 away from sole structure 1010. This can cause medial auxetic portion 1058 to become smaller. Similarly, the user can pull the rearmost lateral lace loop 1080 away from sole structure 1010. This can cause lateral auxetic portion 1060 to become smaller.

In some embodiments, article of footwear 1000 can include a securement device used for substantially maintaining the set tension in tensile strands 1050. As a result, the set size of auxetic portions 1056 can be maintained.

For example, in some embodiments, shoelace 1017 can engage tensile strands 1050 for substantially maintaining the set tension in tensile strands 1050. Generally, shoelace 1017 can have an unsecured position, wherein shoelace 1017 unsecures tensile strand 1050 relative to knit element 1031 to allow tensile strands 1050 to be manipulated for adjusting auxetic portions 1058, 1060. Shoelace 1017 can also have a first secured position, represented in FIG. 20, wherein shoelace 1017 can maintain a first amount of tension in tensile strands 1050 for maintaining auxetic portions 1058, 1060 at a first size. Furthermore, shoelace 1017 can have a second secured position, represented in FIG. 21, wherein shoelace 1017 can maintain a second amount of tension in tensile strands 1050 for maintaining auxetic portions 1058, 1060 at a second size.

More specifically, FIG. 20 illustrates an embodiment in which shoelace 1017 has been relatively loosely tied to the wearer's foot, thereby causing tensile strands 1050 to have relatively low tension. FIG. 21 illustrates the embodiment with shoelace 1017 tied relatively tightly to the foot, thereby causing tensile strands 1050 to have relatively high tension. It will be appreciated that the wearer's foot is at rest and footwear 1000 is generally in a neutral position in both FIGS. 20 and 21.

Because auxetic portions 1056 are larger in size when shoelace 1017 is tied loosely, knit element 1031 and upper 1020 can have a larger range of stretching as described in detail above. In contrast, the smaller auxetic portions 1056 exhibited when shoelace 1017 is tied tightly can allow knit element 1031 and upper 1020 to have a smaller range of stretching.

Accordingly, in some embodiments, the user can select how much they want upper 1020 to stretch in longitudinal direction 1007, transverse direction 1008, and/or vertical direction 1009 in response to an input force. As such, stretching behavior of upper 1020 can be tailored to the wearer's needs and desires.

Article of Apparel with Adjustable Auxetic Portion

Figure 22:
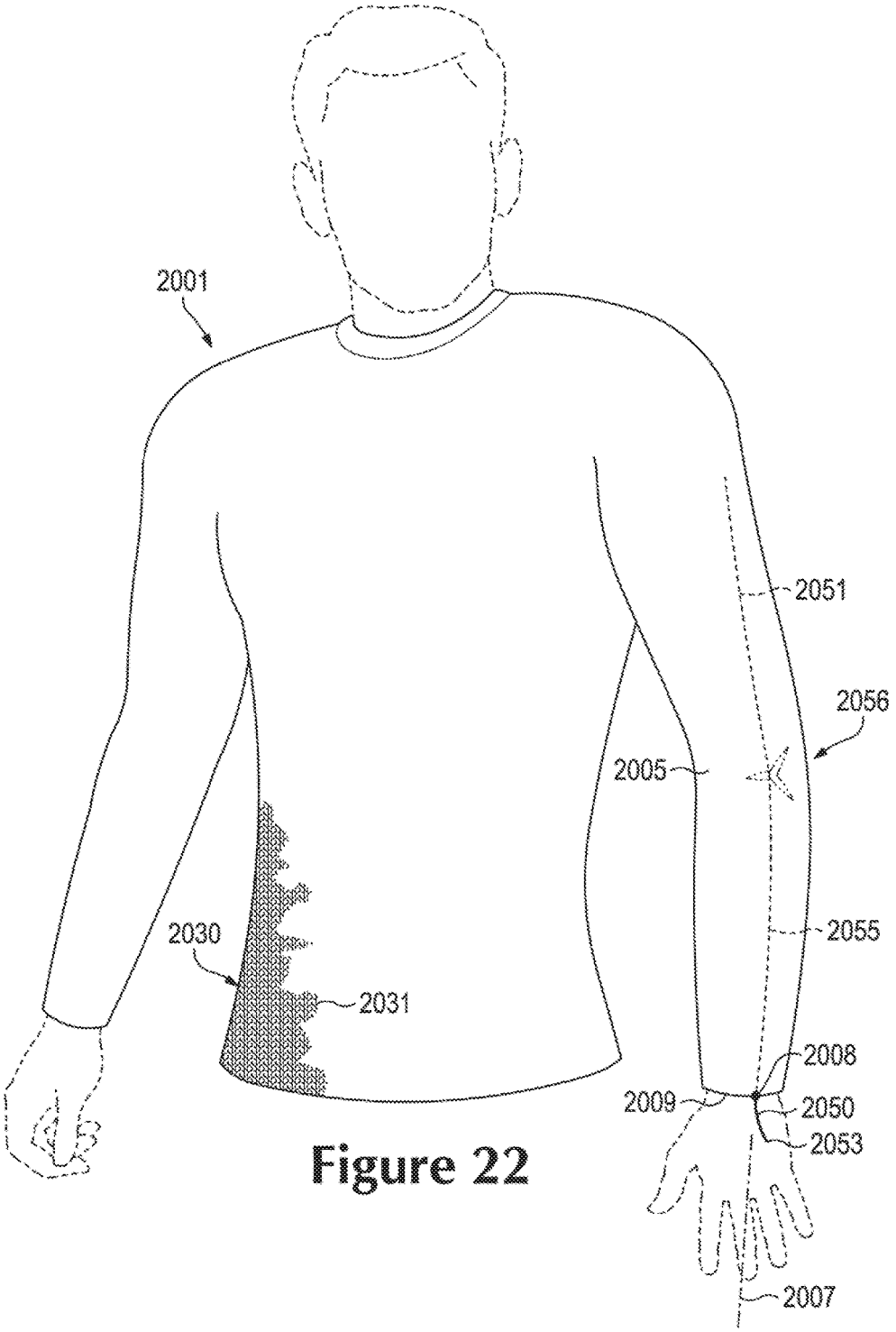
FIG. 22 is a front view of an article of apparel with a knitted component shown in a neutral position.
Figure 23:
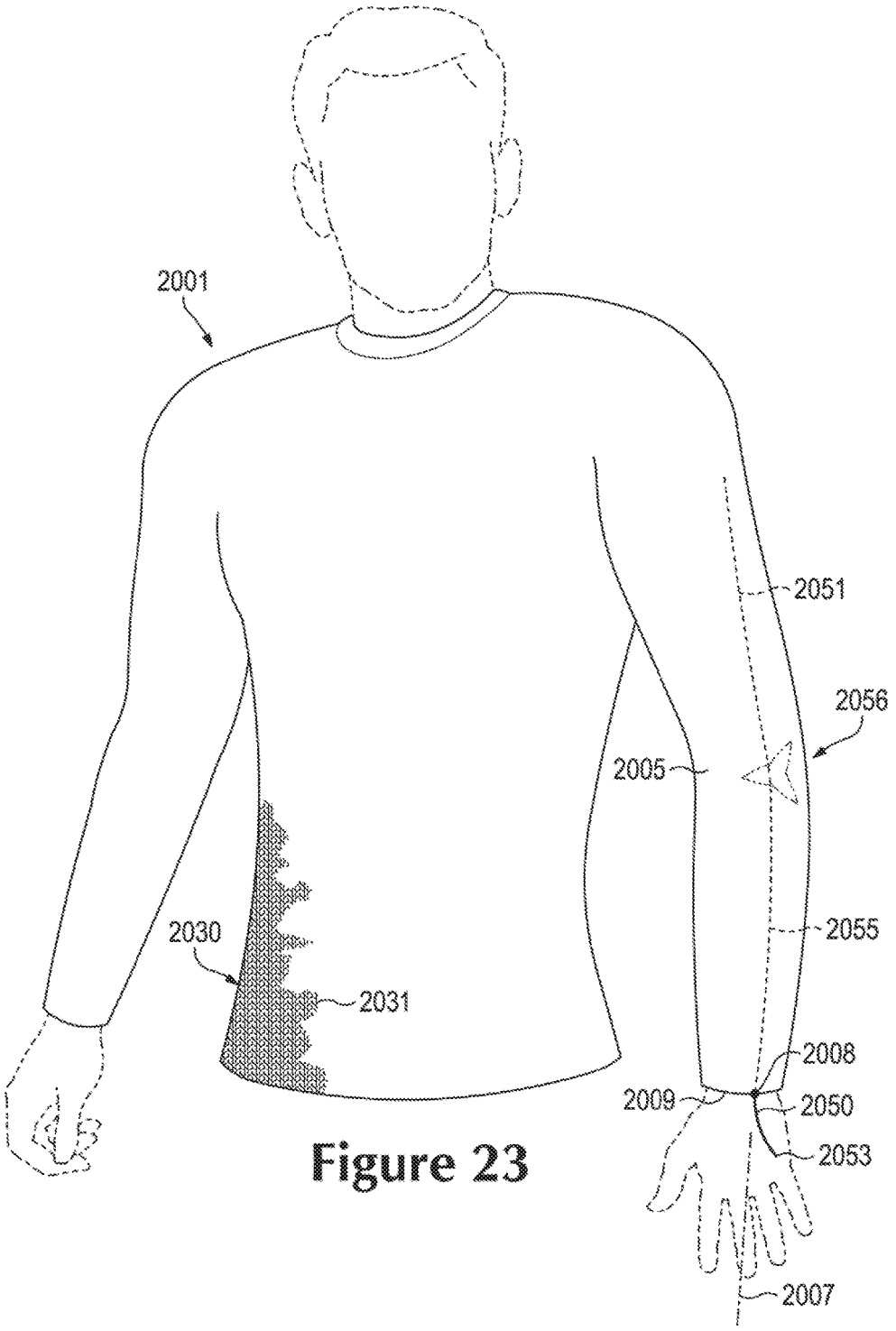
FIG. 23 is a front view of the article of apparel of FIG. 22, wherein the knitted component is in an adjusted neutral position.

Referring now to FIGS. 22 and 23, another embodiment of the present disclosure is illustrated. As shown, an article of apparel 2001 can incorporate a knitted component 2030. Knitted component 2030 can include one or more auxetic portions 2056. Knitted component 2030 can also include a tensile strand 2050 configured for adjusting the size of auxetic portion 2056. By changing tension in tensile strand 2050, the size of auxetic portion 2056 can be selected and changed. As such, the stretching characteristics, such as the range of stretching of knit element 2031 can be selected and changed.

As shown in FIGS. 22 and 23, article of apparel 2001 can be a shirt, sweatshirt, or other article worn on the torso and/or arms. However, it will be appreciated that article of apparel 2001 can be configured for covering other areas of the body. In some embodiments, knitted component 2030 can define a majority of article of apparel 2001. In other embodiments, knitted component 2030 can define a localized area of apparel 2001.

Moreover, auxetic portion 2056 can be incorporated in any suitable area of apparel 2001. For example, auxetic portion 2056 can be incorporated in an area of apparel 2001 proximate an anatomical joint. Thus, auxetic portion 2056 can affect stretching of apparel 2001 that occurs when the wearer flexes the joint. Also, in some embodiments, auxetic portion 2056 can be incorporated in an area that stretches due to flexure of the wearer's muscles or other movements. Specifically, as shown in the illustrated embodiment, auxetic portion 2056 can be incorporated in a sleeve 2005 in an area that is proximate the wearer's elbow. As such, auxetic portion 2056 can stretch, for example, due to flexure of the elbow joint. More specifically, apparel 2001 can stretch and elongate along a longitudinal axis 2007 of sleeve 2005 due to flexure of the elbow joint. Additionally, because of the auxetic nature of apparel 2001, sleeve 2005 can stretch in a circumferential direction extending about longitudinal axis 2007 as a result of this stretching. As such, this circumferential stretching can effectively loosen sleeve 2005 from the wearer's arm in some embodiments. Moreover, like the embodiments discussed above, the range of stretching proximate the elbow joint can be adjusted using tensile strand 2050.

As shown in FIGS. 22 and 23, knitted component 2030 can include a knit element 2031 and one or more tensile strands 2050. In some embodiments, tensile strand 2050 can include a first end 2051, a second end 2053, and a middle section 2055 that is defined between first end 2051 and second end 2053.

In some embodiments, tensile strand 2050 can extend generally along a longitudinal axis 2007 of a sleeve 2005 of apparel 2001. Also, in some embodiments, first end 2051 can be disposed in a proximal region of sleeve 2005, and second end 2053 can be disposed in a distal region of sleeve 2005.

Tensile strand 2050 can be engaged to auxetic portion 2056 in any suitable fashion. For example, in some embodiments, tensile strand 2050 can engage auxetic portion 2056 in a manner corresponding to FIGS. 8-13. In other embodiments, tensile strand 2050 can engage auxetic portion 2056 in a manner corresponding to FIGS. 14-17. It will be appreciated that tensile strand 2050 can be engaged with auxetic portion 2056 in other ways as well without departing from the scope of the present disclosure.

Similar to the embodiments discussed above, the user can pull on tensile strand 2050 to change the size of auxetic portion 2056. As a result, the stretching range of sleeve 2005 can be selected and adjusted. Thus, in some embodiments, the wearer can configure the sleeve 2005 to have a larger range of flexion when desired. The wearer can alternatively configure the sleeve 2005 to have a smaller range of flexion when desired.

In some embodiments, first end 2051 can be fixed to knit element 2031. In contrast, second end 2053 can be exposed from knit element 2031 and can extend from knit element 2031. The wearer can pull on second end 2053, for example, to adjust auxetic portion 2056. Assuming that auxetic portion 2056 is in the position of FIG. 22, for example, the wearer can pull on second end 2053 to adjust auxetic portion 2056 to the larger size position of FIG. 23. As a result, the user can enlarge the range of stretching of apparel 2001.

Additionally, in some embodiments, apparel 2001 can include a securement device 2008. Securement device 2008 can be used to secure tensile strand 2050 and, thus, auxetic portion 2056 at the selected size and position. Securement device 2008 can include a clamp, a tie, a spool, or other implement that detachably secures tensile strand 2050 to knit element 2031. In the embodiment illustrated, for example, securement device 2008 is shown schematically and proximate a cuff 2009 of apparel 2001. Securement device 2008 can detachably secure second end 2053 to cuff 2009 to maintain auxetic portion at the desired size. In additional embodiments, securement device 2008 can be a removable knot formed in tensile strand 2050, and the knot can interfere with cuff 2009 to prevent second end 2053 from sliding into knit element 2031 when sleeve 2005 stretches.

It will be appreciated that apparel 2001 can also include additional tensile strands 2050 with additional auxetic portions 2056 at different areas. These auxetic portions 2056 can be individually adjusted such that the respective areas of apparel 2001 can exhibit different stretch characteristics.

In summary, the knitted components discussed above can include knitted auxetic portions that allow knitted component to readily stretch in multiple directions as a result of a stretching force that is applied in one of those directions. The amount or range of stretching can be affected, selected, and varied by changing the size of the auxetic portions. For example, the size of auxetic portions can be conveniently changed by manipulating and changing tension within tensile strands. Thus, the knitted component can be tailored according to the needs and desires of the user.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims. Moreover, as used in the claims, "any of" when referencing the previous claims is intended to mean (i) any one claim, or (ii) any combination of two or more claims referenced.

We claim:

1. A knitted component, the knitted component comprising:

a knit element that includes an auxetic portion configured to move between a first position and a second position as the knitted component stretches; and a tensile strand inlaid within at least one of a course and a wale of the knit element, wherein the tensile strand extends through the auxetic portion, wherein the tensile strand is selectively securable to the knit element via a securement device, and wherein the securement device is spaced from the auxetic portion.

2. The knitted component of claim 1, wherein the securement device includes at least one of a clamp, a tie, a spool, and a knot.

3. The knitted component of claim 1, wherein the securement device is located proximate an edge of the knit element.

4. The knitted component of claim 1, wherein the securement device is detachable from the tensile strand, and wherein the tensile strand is movable relative to the securement device when the securement device is in a detached state.

5. The knitted component of claim 1, wherein changing the area of the auxetic portion causes a variation in a stretch characteristic of the knitted component.

6. The knitted component of claim 1, wherein the tensile strand has a longitudinal axis, and wherein the tensile strand is configured to slide along its longitudinal axis relative to a border of the auxetic portion.

7. The knitted component of claim 1, wherein the auxetic portion has greater elasticity than an adjacent knit zone of the knit element.

8. The knitted component of claim 1, wherein the auxetic portion is shaped substantially as a re-entrant triangle.

9. A knitted component, the knitted component comprising:

a knit element that includes an auxetic portion configured to move between a first position and a second position as the knitted component stretches; and a tensile strand inlaid within at least one of a course and a wale of the knit element, wherein the tensile strand extends through the auxetic portion, wherein the tensile strand is selectively securable to the knit element via a securement device, wherein the securement device is located at an edge of the knit element.

10. The knitted component of claim 9, wherein the securement device includes at least one of a clamp, a tie, a spool, and a knot.

11. The knitted component of claim 9, wherein the tensile strand extends through a second auxetic portion.

12. The knitted component of claim 9, wherein the securement device is detachable from the tensile strand, and wherein the tensile strand is movable relative to the securement device when the securement device is in a detached state.

13. The knitted component of claim 9, wherein changing the area of the auxetic portion causes a variation in a stretch characteristic of the knitted component.

14. The knitted component of claim 9, wherein the tensile strand has a longitudinal axis, and wherein the tensile strand is configured to slide along its longitudinal axis relative to a border of the auxetic portion.

15. The knitted component of claim 9, wherein the auxetic portion has greater elasticity than an adjacent knit zone of the knit element.

16. The knitted component of claim 9, wherein the auxetic portion is shaped substantially as a re-entrant triangle.

17. A method, comprising:

forming a knitted component on a knitting machine, wherein the knitted component includes:

a knit element that has an auxetic portion configured to move between a first position and a second position as the knitted component stretches; and a tensile strand inlaid within at least one of a course and a wale of the knit element, wherein the tensile strand extends through the auxetic portion; and locating a securement device at an edge of the knit element, wherein the securement device is configured to selectively secure the tensile strand to the knit element.

18. The method of claim 17, wherein the securement device includes at least one of a clamp, a tie, a spool, and a knot.

19. The method of claim 17, wherein the tensile strand extends through a second auxetic portion.

20. The method of claim 17, wherein the securement device is detachable from the tensile strand, and wherein the tensile strand is movable relative to the securement device when the securement device is in a detached state.

* * * * *